US005310335A

United States Patent [19]

van Berkum

[11] Patent Number: 5,310,335

[45] Date of Patent: May 10, 1994

[54] TRIM SYSTEM FOR FUEL COMBUSTION SYSTEMS

[75] Inventor: Robert A. van Berkum, Chagrin Falls, Ohio

[73] Assignee: Robert A. van Berkum, Chagrin Falls, Ohio

[21] Appl. No.: 878,634

[22] Filed: May 5, 1992

[51] Int. Cl.[5] ..... F23N 5/00

[52] U.S. Cl. ..... 431/12; 431/89; 431/20; 431/76

[58] Field of Search ..... 431/12, 20, 76, 90, 431/89, 75, 79; 236/15 BD, 15 E; 122/448 R

[56] References Cited

U.S. PATENT DOCUMENTS

| | | | |
|---|---|---|---|
| 3,814,570 | 6/1974 | Guigues . | |
| 4,264,297 | 4/1981 | van Berkum . | |
| 4,509,912 | 4/1985 | van Berkum . | |
| 4,580,546 | 4/1986 | Barnett | 126/58 |
| 4,688,547 | 8/1987 | Ballard et al. | 126/110 R X |
| 4,729,207 | 3/1988 | Dempsey et al. | 126/116 A X |
| 4,747,355 | 5/1988 | van Berkum . | |
| 5,076,782 | 12/1991 | Campbell et al. | 431/89 |

OTHER PUBLICATIONS

The Babcock & Wilcox Co., Bailey Product Specification Brochure, Industrial Combustion Control System, Sep. 1988.

Ametek, Inc., Air-Mizer II Combustion Air Trim Control System Brochure, Aug. 1981.

*Primary Examiner*—Larry Jones

*Attorney, Agent, or Firm*—Fay, Sharpe, Beall Fagan, Minnich & McKee

[57] ABSTRACT

A method and apparatus for applying exhaust gas analysis to simple combustion control systems wherein the fuel flow and air flow control devices are interconnected with fixed mechanical linkage, or interconnected by a single specific signal, between the fuel flow and air flow control devices. An apparatus and method are disclosed to automatically compensate the air-to-fuel ratio, pre-calibrated on a volume basis, for uncontrolled variations of air or fuel quality such as density, BTU content and the like so that the calibration of the rate of combustion air flow relative to the rate of fuel flow will always be substantially correct even while these flow rates are changing.

17 Claims, 18 Drawing Sheets

FIG. 6 POSITION OF FIRST MOVABLE FLOW CONTROL ELEMENT AS A % OF TOTAL AVAILABLE TRAVEL

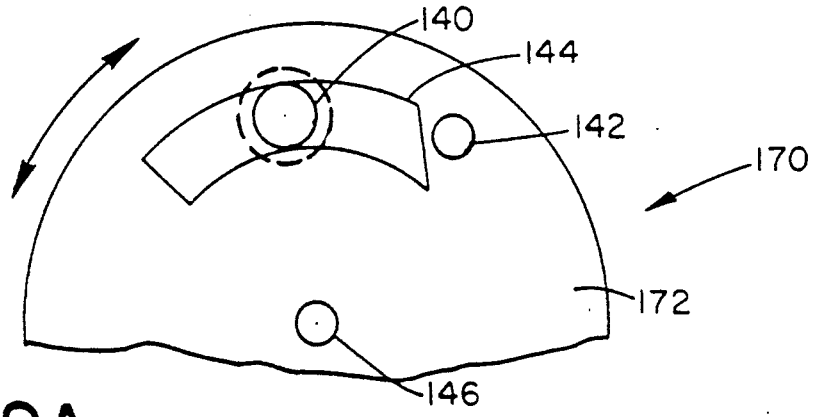
9A INLET PLATE
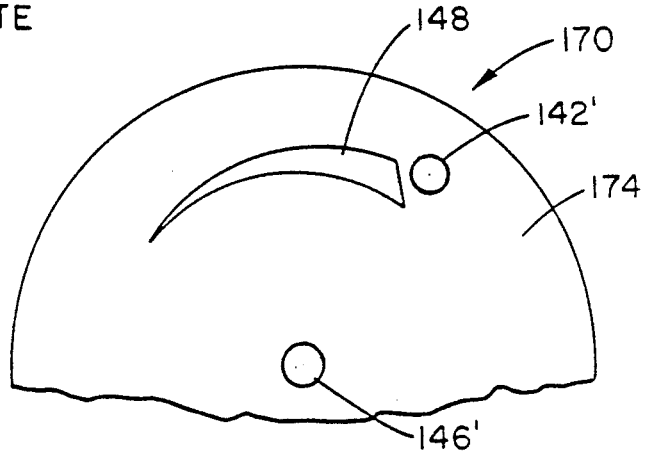
9B PORT AREA PLATE
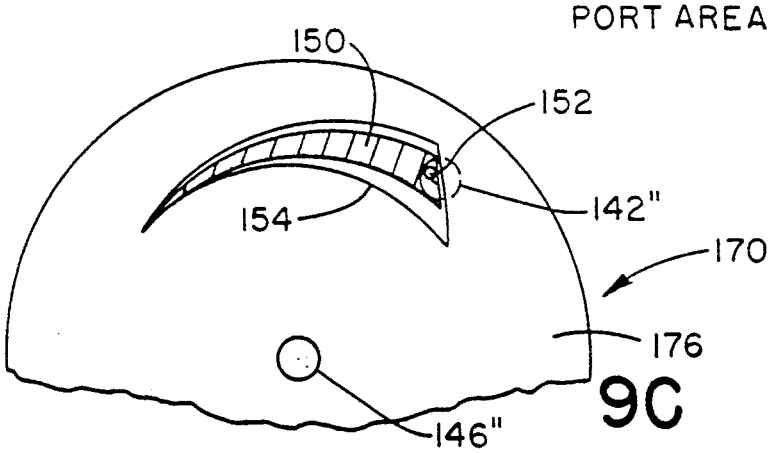
9C SECOND MOVABLE ELEMENT IN ITS HOLDING PLATE
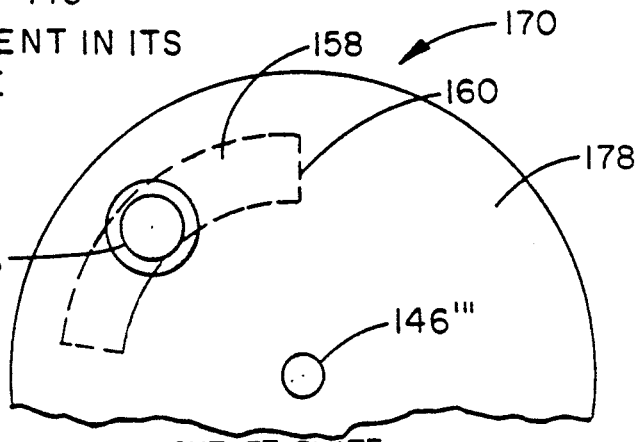
9D OUTLET PLATE

TRIM SYSTEM FOR FUEL COMBUSTION SYSTEMS

BACKGROUND OF THE INVENTION

1. Field of Invention

This invention relates to the art of combustion of fuels and specifically to methods and apparatuses for optimizing the flow of air and fuel to the combustion apparatus to maximize combustion efficiency.

More specifically, this invention relates to simple combustion control systems employing mechanical linkage, or one specific unaltered signal, to position the fuel and air control devices to achieve the desired rate of energy release and also provide a means of maintaining the desired fuel to air ratio at all times despite variations in the qualities of the fuel or air. These variations can be caused by changes in density, moisture content, BTU value and the like, and by the method of this invention effectively overcoming the time lag existing between the formation of the fuel and air mixture and the analysis of exhaust gases.

2. Description of the Related Art

It is known in the art to adjust the combination of air and fuel being supplied to the combustion chamber to maximize the combustion efficiency. It is also known in the art to accomplish this through means of a mechanical linkage control. It is also known in the art to analyze the exhaust gases of the combustion process in order to determine whether or not proper combustion is taking place and what adjustments need to be made. It is also known in the art to provide a signal from an exhaust gas analyzer to drive different control mechanisms, such as valves and dampers.

When fuel is combusted with air, the flow of air and fuel must be controlled in a chemically correct relationship to achieve the most efficient combustion. A common way of achieving the desired air flow and fuel relationship is to interconnect the air flow regulating devices with the fuel control devices by means of mechanical linkages or control signals in a pre-calibrated manner. The mechanical linkages or control signals are pre-calibrated so that, as the rate of combustion is increased or decreased in response to the energy release requirements of the end user, the air and fuel control devices operate in a manner that provides the desired relationship between fuel flow and air flow regardless of the rate of combustion or energy release requirement of the combustion apparatus.

One disadvantage of the above-described system is that it is unresponsive to day-to-day variations in the atmosphere, fuel, and other factors which can affect the combustion equation. For example, variations in fuel qualities, and ambient temperatures, and moisture content of the combustion air, and the like can alter the chemical correctness of the pre-calibrated relationship between air flow and fuel flow. In such cases, the combustion process operates less efficiently.

The above-described changes to the desired chemical relationship between air flow and fuel flow are commonly detected by sensors which monitor the exhaust gases of the combustion chamber. The sensors can detect the amount of residual, unburned oxygen and/or the amounts of carbon monoxide, carbon dioxide, or other substances in the products of combustion which exit the combustion chamber with the exhaust gases. Such detecting devices have been used in connection with various control devices to correct for the variations affecting the desired air flow to fuel flow chemistry. Most of these systems suffer from a relatively high installed cost and are complex. Further, many have inadequate performance and require specialized maintenance and the like.

To avoid the complexity and high installed cost of the prior art devices, this invention provides a relatively simple means of compensating for the effect of temperature and similar variations on the desired chemically correct pre-calibrated relationship between air flow and fuel flow. The invention enables the pre-calibrated relationship between fuel flow and air flow to be compensated for differences by adding a second moveable element to one or more of the prior art flow control devices.

The prior art flow control devices work on the principle of an established known relationship between the position of a moveable element or interconnected moveable elements designed to increase or decrease port area within the device through which the fluid can pass. By increasing the port area within the device, the rate of fluid flow can be increased. This relationship is commonly known as the "flow characteristic" of the flow control device.

It is known that the molecular content of the fluid flowing through the device increases or decreases with variations in temperature, solution, mixture strength, and other variations in the fluid's quality. Consequently, when the control device is used in a pre-calibrated manner to deliver a desired chemically correct rate of flow, the flow characteristic of the flow control device must be altered to compensate for the effect of the temperature difference or other variation in fluid quality. This invention provides a means for such flow control device to also have the capability to compensate for variations in temperature, fluid qualities, etc. This invention correctly adjusts the pre-calibration between the rate of combustion air flow control device and the rate of fuel flow control device to compensate for uncontrolled variations in air or fuel quality so that at any and all air and fuel rates of flow the pre-calibrated relationship between the air and fuel control devices will be substantially correct before, during and after rate of flow changes. The method of this invention largely overcomes the detrimental effect of the time lag existing between the point of fuel and air mixture formation and the exhaust gas analysis relating to that specific mixture This invention further provides a fail safe mechanism which permits the combustion process to proceed safely without interruption should faults occur in the exhaust gas analyzer, controller, or motion generation means for positioning the compensating second moveable element.

SUMMARY OF THE INVENTION

To avoid the limitations and disadvantages of present devices and methods, an object of this invention is to automatically, or manually, during on-line operation, compensate the pre-calibration existing between the combustion air control means and the fuel control means for variations in air and or fuel quality which tend to render the original pre-calibration inefficient for combustion purposes.

A further object of this invention is to achieve this compensating action so that before, during and after changes in fuel and air flow rates the desired efficient air to fuel ratio will be maintained despite variations in air and/or fuel quality.

A further object of this invention is a fail-safe means such that the combustion process can continue at a safe level of excess air without interruption should a fault occur in the exhaust gas analyzer, the controller responsive to the exhaust gas analyzer or the motion generation means for positioning the second moveable element which carries out the compensating function.

A further object of this invention is a significant reduction in installed cost due to the simplicity of the invention to facilitate more widespread use.

These and other objects of the invention are provided by the addition of a second moveable element to the prior art rate of flow control device for either the fuel flow or the combustion air flow.

This invention comprises one or more rate of fuel flow control means. The first of these fuel flow control means is a rate of combustion air flow control device comprising a first moveable element whose motion is connected by fixed mechanical linkage to the controlling element of the rate of fuel flow control means, or connected by a specific unaltered signal to the controlling element of the rate of fuel flow control means. The combustion air flow control device comprises a port through whose port area the combustion air must flow. The first moveable element of the air flow control device controls the combustion air flow rate through the port by moving among a variety of positions to expose more or less of the available port area and establishing a specific relationship between first moveable element travel position and resultant fluid volume flow. This combustion air flow control device also comprises a second moveable element designed to increase or decrease the port area available to the action of the first moveable element at all of its possible travel positions, thereby altering the specific relationship established between the first moveable element travel position and the rate of volume flow through the rate of combustion air flow control device and thereby providing a means of applying correction to that specific relationship to compensate for variations in air or fuel quality.

This invention further comprises an analyzer to determine the composition of the exhaust gases of combustion, and a controller for comparing the composition of the exhaust gases to a desired value or set of values, and sending out a corrective control signal. In addition, a motion generator means responsive to the controller and connected to suitably position the second moveable element, means to detect faults in the exhaust gas analyzer, the controller, and the motion generator means of positioning the second moveable element of the fuel or the air rate of flow control device.

A fail safe spring or counterweight responsive to fault detection devices positions the second moveable element of the rate of flow control device to a position that provides additional excess air for safe combustion during fault conditions The control system requires the second moveable element to be comprised in either the fuel flow or the air flow control device For fail safe action with the fuel flow device, the action would be to reduce the fuel rate of flow relative to air flow. When using the air flow device for compensation, the fail safe device would increase the air flow. In either case, a safe margin of excess air is established so that the combustion process need not be interrupted due to faults in the exhaust gas analyzer, controller, or second moveable element actuator. The fail safe means comprises a means of decoupling, such as a clutch, or freewheeling or overriding of the actuator which positions the second moveable element. For example, when using a stepper motor as an actuator, it is merely necessary to disconnect electric power to allow the spring or counterweight to override the stepper motor and position the second moveable element to the desired safety position.

Either the fuel flow control device or the air flow control flow control device must be equipped with a means to precalibrate the relationship between its first moveable element travel position and the resulting controlled flow. Because the movement of this first moveable element is mechanically or otherwise unalterably linked to the flow control actuating means of the other component of the fuel and air mixture, this precalibration of at least one of the flow control devices sets up an initial desired air to fuel ratio which can be compensated for variations in fuel or air quality as required.

BRIEF DESCRIPTION OF THE DRAWINGS

FIG. 9A–9D are schematic representations of the disks of a circular valve embodiment of the invention;

DESCRIPTION OF THE PREFERRED EMBODIMENT

Before proceeding with the description of the preferred embodiment, reference will first be made to FIG. 1 which illustrates a typical prior art arrangement commonly used on burners and other combustion apparatus to maintain a predetermined air to fuel flow rate ratio. The system of FIG. 1 is commonly known as a jack shaft system.

Figure 1:
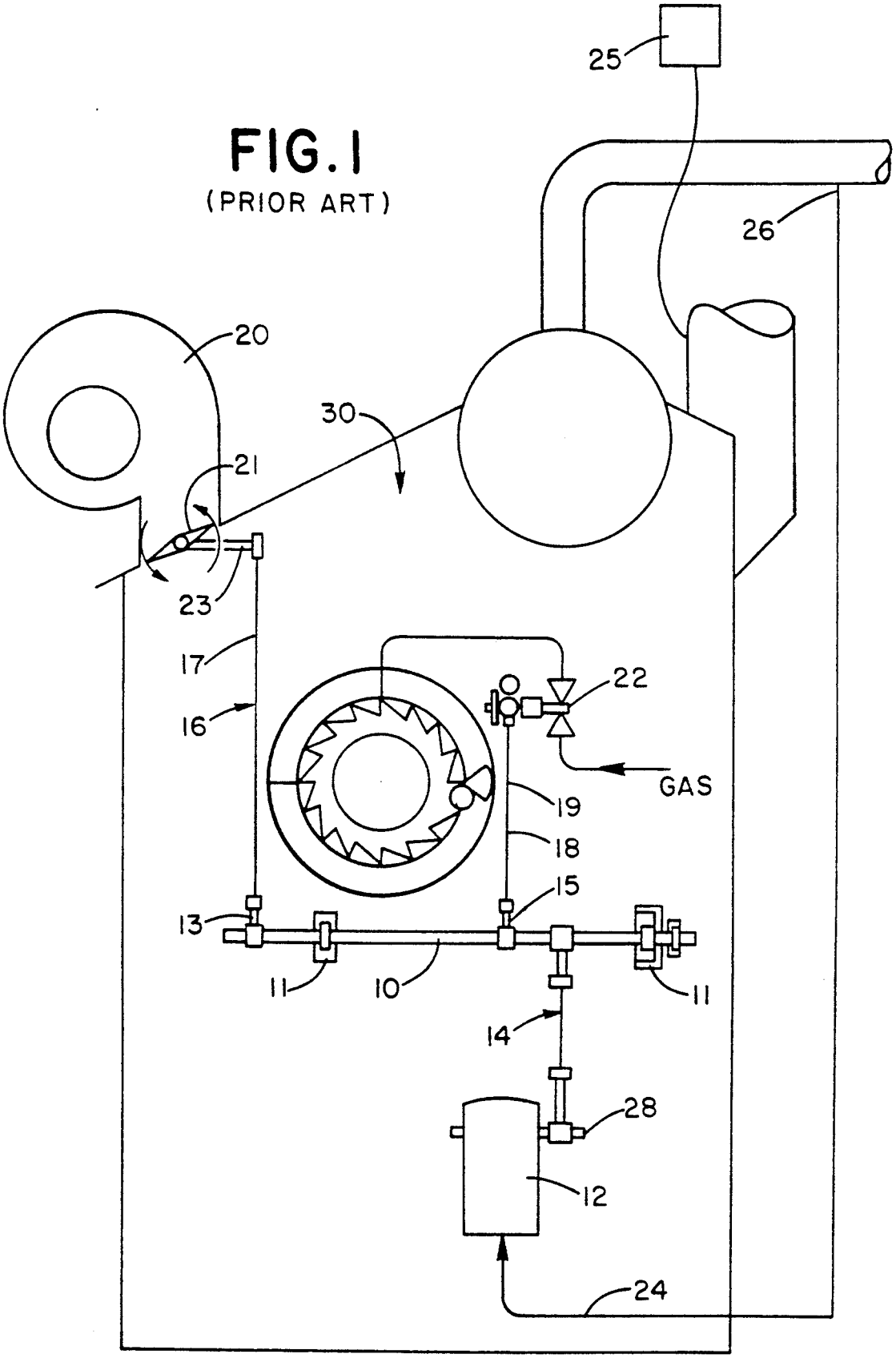
FIG. 1 (PRIOR ART)
FIG. 1 is a schematic plan view of a typical prior art jack shaft combustion control apparatus wherein the fuel valve is mechanically linked to an air flow control device in a pre-calibrated manner to establish a desired relationship between combustion air flow and fuel flow.

There is shown in FIG. 1 combustion apparatus designed generally as 30. Two flow control devices, designated 21, 22, provide for a flow or air and fuel to the combustion apparatus 30. Flow control 21 is a damper regulating air flow from a fan designated as 20. Flow control device 22 is a fuel flow control device having means to regulate the flow of natural gas or other fuel to the combustion chamber of apparatus 30. A jack shaft 10 is mounted on suitable bearings 11 and is adapted to be rotated by means of actuator 12. Actuator 12 is connected to jack shaft 10 by means of linkage 14. A plurality of linkages 16, 18 interconnect jack shaft 10 the flow control devices 21, 22. Linkages 16, 18 are made up of levers 13, 15 fixed to the jack shaft 10 and links 17, 19. The actuator 12 is controlled electrically or pneumatically by means of circuit 24 responsive to a suitable controlling apparatus for regulating the desired rate of energy release generally designated 26.

It should be appreciated from the study of FIG. 1 that rotation of the output shaft 28 of actuator 12 produces rotation of jack shaft 10 with associated control of flow devices, 21, 22 through respective linkages 16, 18. When the combustion apparatus 30 is originally calibrated, a burner service technician carefully determines a linkage and fuel calibration which, at any load, places the damper 21 in the correct position relative to the fuel valve 22 such that the proper air flow-fuel flow ratio for that firing rate is attained.

However, operating conditions change, making it desirable to recalibrate the control system of the combustion apparatus 30. For example, changes in air temperature and relative humidity will effect the amount of oxygen delivered to the burner for a given damper 21 position. The amount of oxygen delivered to the burner for any position of the jack shaft can change as much as 19% or more in practice due to the factors previously mentioned. Similarly, changes in fuel heating value, viscosity, and specific gravity will produce changes in the combustion equation, as will the point of origin of the fuel being burned. Obviously, the original calibration is correct for the conditions existing when the service technician calibrated the combustion apparatus, but changing conditions as described above require that the original calibration be altered to compensate for the effect of these changing conditions A simple, inexpensive, yet effective means of providing such compensation will now be explained with reference to FIGS. 2-7.

Figure 2:
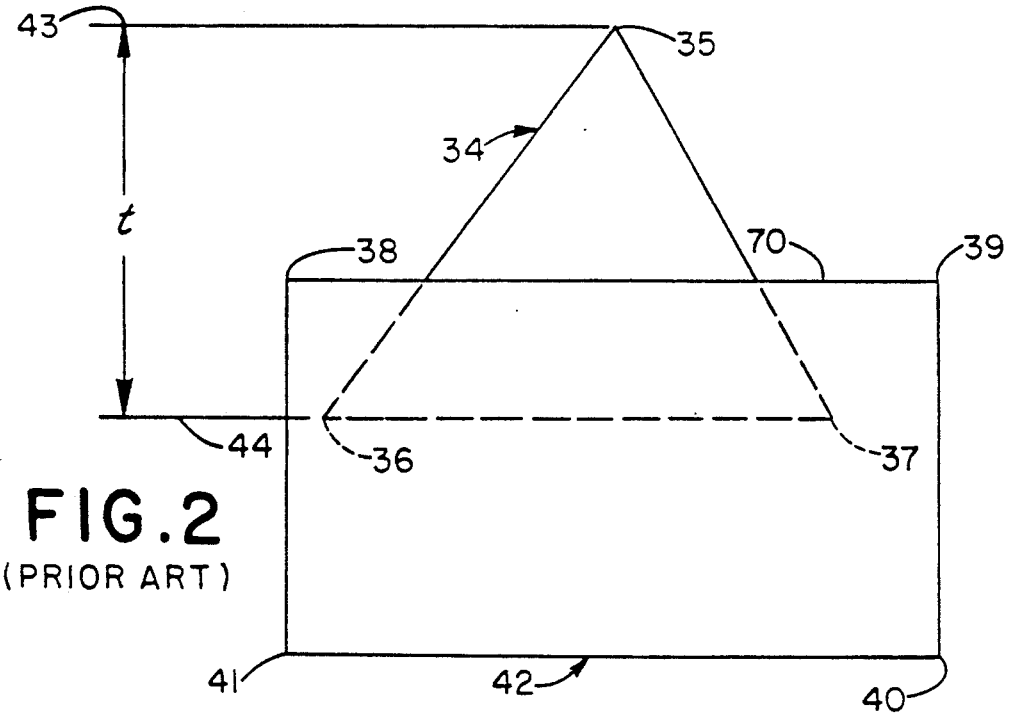
FIG. 2 (PRIOR ART)
FIG. 2 is a schematic representation of operative elements of a prior art V-port control flow control device which can increase or decrease the port area to control the rate of volume flow.
Figure 5:
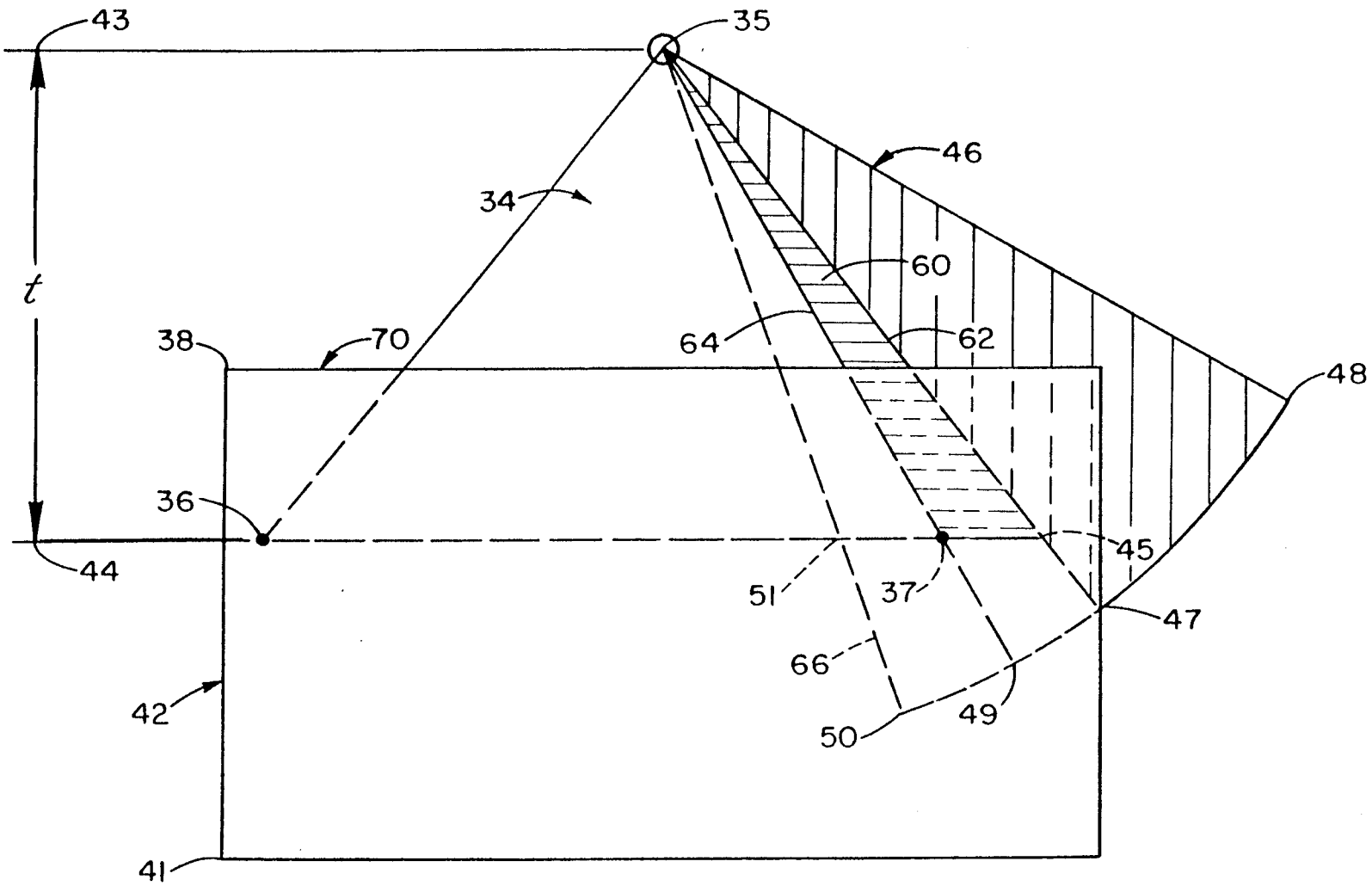
FIG. 5 is a schematic representation of the modification of the operative elements of the prior art V-port flow control device of FIG. 3, modified according to the invention.

With reference to FIG. 2, the principle of operation of a prior art V-port control valve is schematically represented. Triangle 34, encompassed between points 35, 36, 37 represents the available port area. Rectangle 42, encompassed 38, 39, 40, 41, represents a first moveable element 42 with a leading edge 70. The leading edge 70 extends between points 38 and 39 can travel from a closed position to an open position. In FIGS. 2 and 5, "t" represents the travel of the leading edge 70 of the first moveable element 42 travels up to the point where it is coincident with a line designated 43. In this closed position, no portion of the available port area (i.e. the area of triangle 34) is exposed to allow fluid to pass through the flow control device.

The open position is reached when the leading edge 70 is coincident with line 44. At this position, all of the available port area is exposed to allow maximum flow rate of fluid through the control device.

Figure 3:
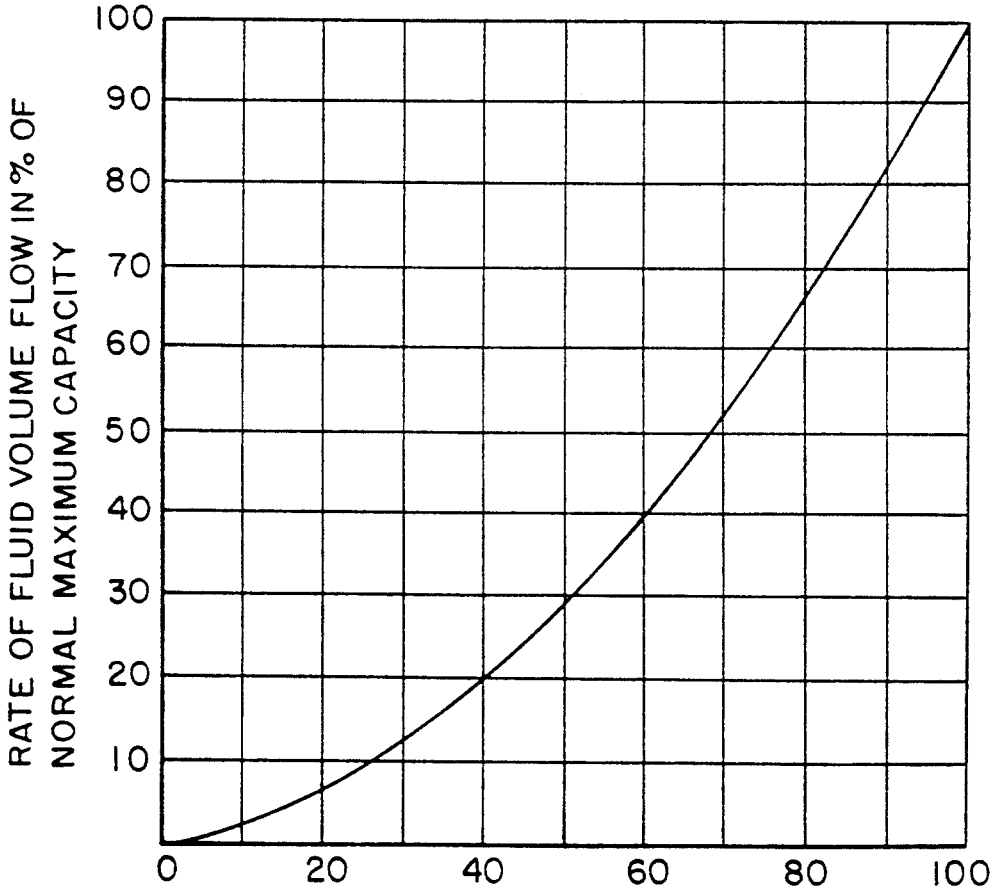
FIG. 3 (PRIOR ART)
FIG. 3 is a graph depicting a typical relationship between a rate of volume flow and a travel position of a first moveable control element in a prior art V-port flow control device.

With reference to FIG. 3, there is disclosed a graph depicting a typical relationship between the rate of fluid flow and the travel position of the first moveable element 42 for this prior art V-port configuration.

Figure 4:
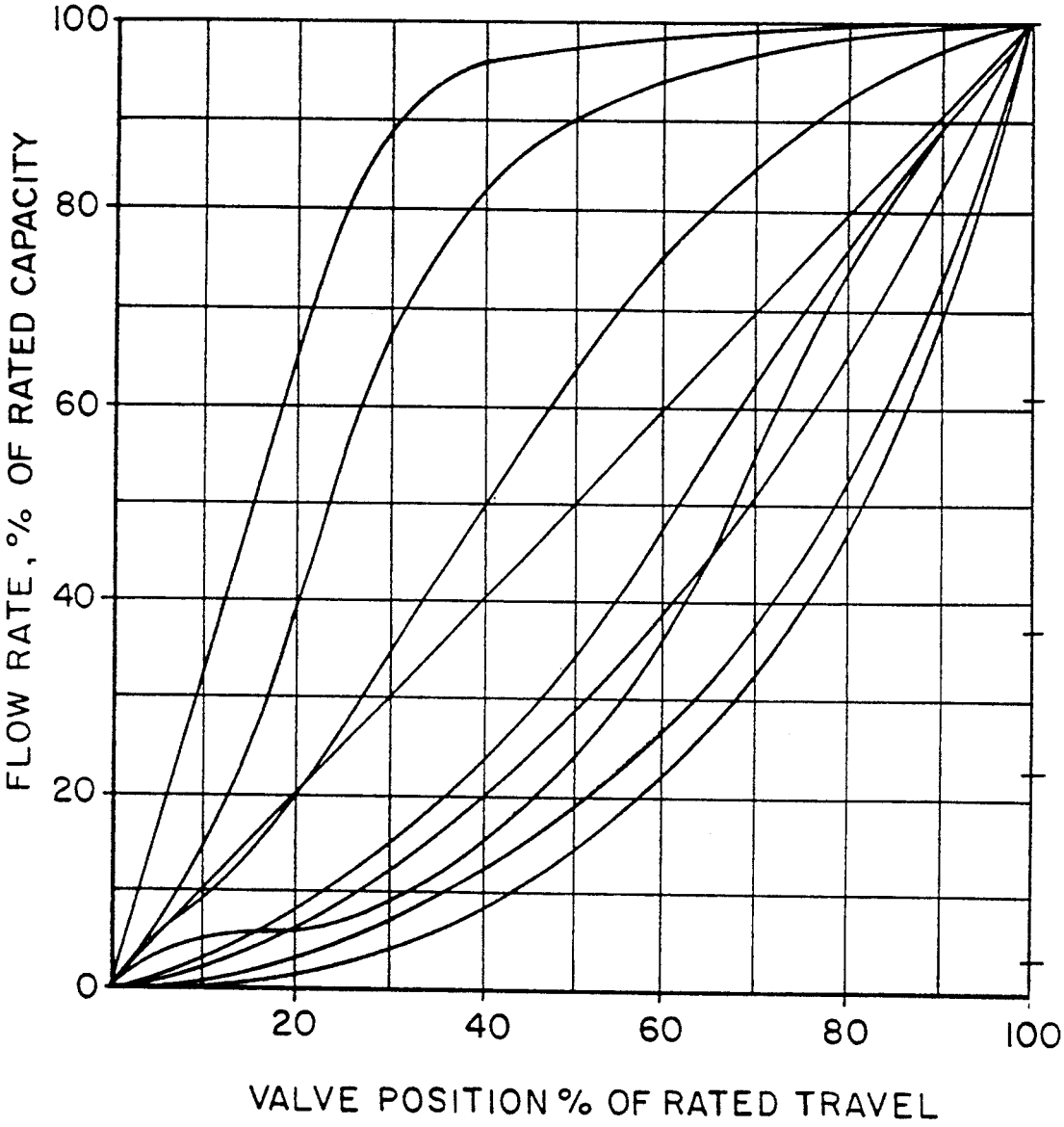
FIG. 4 (PRIOR ART)
FIG. 4 is a graph depicting a typical relationship between rate of volume flow and a travel position of a first moveable element for various prior art configurations of flow control devices.

FIG. 4 is a graph depicting various typical relationships between rate of fluid flow through the flow control device and the travel position of the first moveable element 42 in various configurations of prior art flow control devices.

FIG. 5 schematically shows a means of fluid flow control of the invention.

With reference to FIG. 5 (and comparing FIG. 5 with FIG. 2) the total available port area 34, that area of the triangle encompassed between points 35, 36, 37, has been enlarged by the addition of a triangular port area 60, encompassed by points 35, 37, and 45. This second triangular port area 60 is shown in FIG. 5 with horizontal shading to assist the reader in his understanding.

With continuing reference to FIG. 5 there is provided a second moveable element 46, encompassed between points 35, 47, and 48. This second moveable element 46 is shown in FIG. 5 with vertical shading to assist the reader in his understanding. The second moveable element 46 is pivoted at point 35 and is located behind the V-port area opening 34, in relationship to the first moveable element 42, which is positioned in front of V-port opening 34 in FIG. 5.

In practice, the relative locations of the first and second moveable elements 42, 46 to the port area 34 and to each other can be whatever is expedient to the equipment designer, providing that their interaction achieves the desired control action of compensation. Pivoted second moveable element 46 can be positioned so that its leading edge 62, the line between points 35 and 47, can be moved to coincide with line 64 between end points 35 and 49. This position is called the "normal" port area position. The second moveable element 46 can also be positioned so that its leading edge 62 is coincident with line 66, between end points 35 and 50, which is called the "minimum total available port are position." The second moveable element 46 can be positioned so that its leading edge 62 can be coincident with any line that can be drawn between point 35 and any point on the segment represented by the arc between points 47 and 50.

Figure 6:
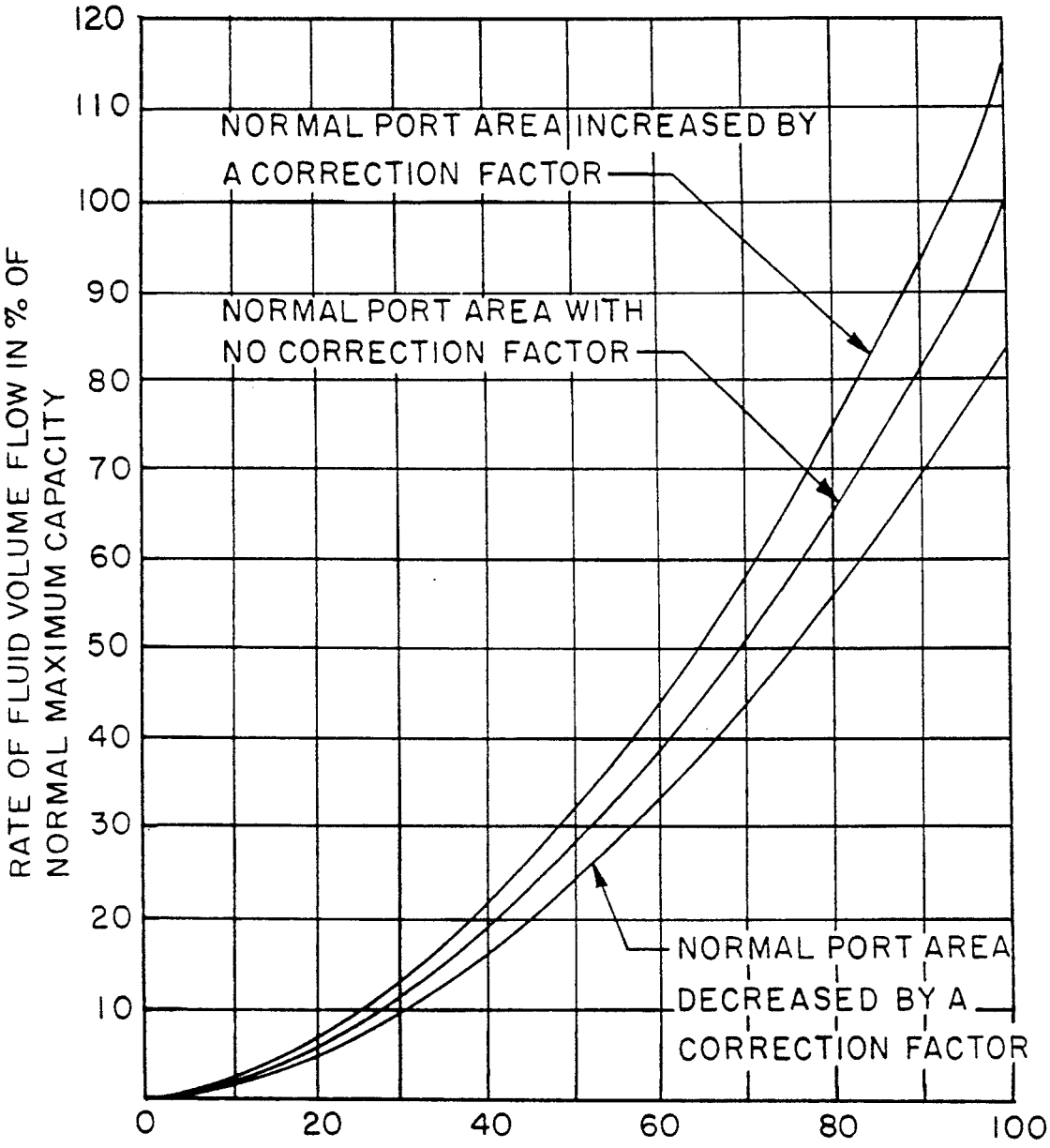
FIG. 6 is a graph depicting the relationship between rate of volume flow and travel position of first and second moveable flow control elements in the V-port flow control device of the invention.

With reference to FIG. 6, there is disclosed a graph depicting the relationship between the rate of fluid volume flow and the travel position of the first moveable element 42 of FIG. 5 at three typical positions of the second moveable element 46. At the normal position, the total port area available to the action of the first moveable element 42 is the triangular area 34 encompassed by points 35, 36 and 37 of FIG. 5. This is the same port area depicted in FIG. 2. Consequently, the rate of fluid flow to travel relationship at the normal position of the second moveable element 46, as depicted in the graph in FIG. 6, is generally the same as shown in the graph in FIG. 3 for the prior art V-port valve.

By positioning the leading edge 62 of the second moveable element 46 of FIG. 5 so that it is coincident with a line between end points 35 and 47, the total port area available to the flow control action of the first moveable element 42 is increased to provide a larger volume flow at every position of the first moveable element 42 throughout its available travel. This increased port area compensates for a condition requiring an increased volume flow. This newly increased relationship between rate of fluid volume and flow and first moveable element travel is depicted on the graph shown in FIG. 6 relating to a port area increased by a correction factor.

Similarly, by positioning the leading edge 62 of this second moveable element 46 to be coincident with the line between end points 35, 50, the total port area available to the flow control action of the first moveable element 42 is decreased to provide a lesser volume flow at every position of the first moveable element 42 throughout its available travel. This lower volume flow compensates for a condition requiring a reduced volume flow. Again, this newly decreased relationship between rate of fluid volume flow and first moveable element 42 travel is depicted in the graph in FIG. 6 relating to a port area decreased by a correction factor.

In summary, with second moveable element 46 having its leading edge 62 coincident with a line between end points 35 and 49, a position called the normal position, no correction factor is applied to the relationship between the rate of volume flow and travel position of the first moveable element 42 as depicted in the graph in FIG. 5. As the leading edge 62 of the second moveable element 46 is positioned away from the normal position, and toward a position coincident with a line between end points 35 and 47, any desired increasing correction factor can be applied to the normal relationship between rate of fluid volume flow and the travel position of a first moveable element 42 as depicted in the graph in FIG. 5. Similarly, as the leading edge 62 of second moveable element 46 is positioned away from the normal position, and toward a position coincident with the line between end points 35 and 50, any desired decreasing correction factor can be applied to the normal relationship between rate of fluid volume flow and the travel position of first moveable element 42, as depicted in the graph in FIG. 5.

Figure 7:
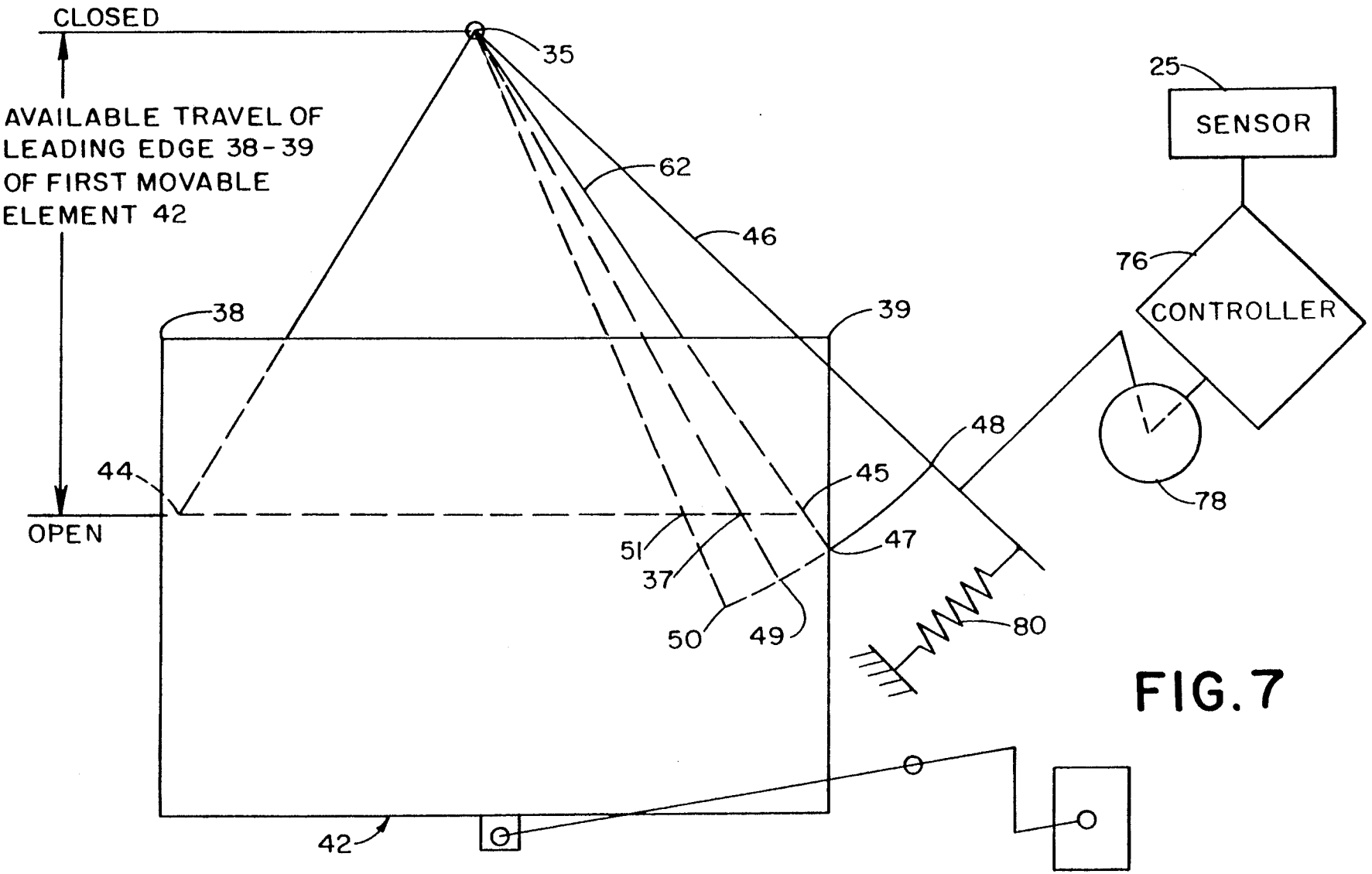
FIG. 7 is a schematic representation of the first moveable element, the second moveable element, the exhaust gas analyzer, the controller responsive to the exhaust gas analyzer, the motion generation means for actuating the first and second moveable elements of the rate of flow control device having compensation capability.

With reference to FIG. 7, a schematic representation of the invention applied to a combustion process is shown. A sensor 25, sends a signal to a controller 76, capable of detecting that a correction to the normal calibration is required. The sensor 25 can be an analyzer for oxygen, carbon dioxide, combustibles, a calorimeter for a heating value, a temperature or pressure sensor, or any other device able to measure a parameter describing the combustion process. When the controller 76 receives the signal from the sensor 25, the controller 76 puts out a suitable corrective action signal to an actuator 78. The actuator 78 positions the second moveable element 46, of a flow control device. The controller 76 and its actuator 78 are designed so that, should corrective action to increase the flow characteristic be required, the leading edge 62 of the second moveable element 46 will be moved in a direction approaching coincidence with the line between end points 35 and 47 until the controller 76 senses that sufficient corrective action has been applied. Similarly, should decreasing flow corrective action be required, the controller 76 and its actuator 78 will move the leading edge 62 of the second moveable element 46 in a direction toward a line coincident with a line between end points 35 and 50.

Preferably, this system should be designed to include fault detection techniques designed to free the motion of the second moveable element actuator 78 in order to permit a spring 80 or other means to position the second moveable element 46 to a desired safe position.

The flow control device of this invention having a first moveable element 42 and a second moveable element 46 may be applied to either a fuel flow control device or a combustion air flow control device or both as desired. Although the preferred embodiment is based on the motion of a pivotal segment acting as the second moveable element 46, many other configurations can be made of a flow control device having a first moveable element establishing a relationship between its travel position and the rate of fluid volume flow through the control device, and also incorporating a second moveable element capable of altering the rate of volume flow relationship between the first moveable element and its travel position.

Figure 8:
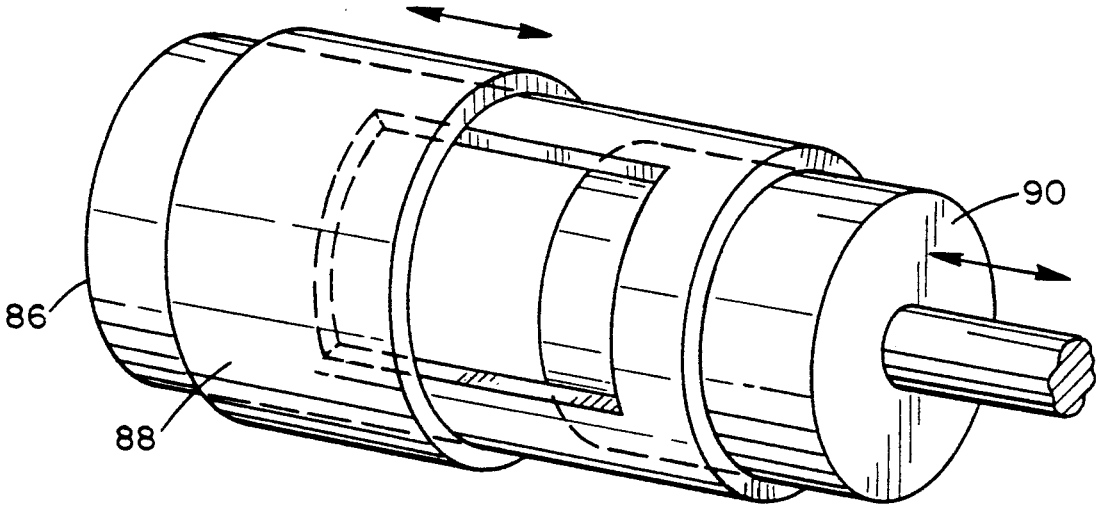
FIG. 8 is an alternate embodiment of the first and second moveable elements according to the invention.

For example, with reference to FIG. 8, the basic port area could be rectangular in shape as incorporated by a valve assembly utilizing concentric cylinders. In such an embodiment, cylindrical element 88, containing one or more rectangular ports rotates about cylindrical element 86 which contains a similar port or ports such that the effective port area is varied. In this same configuration, element 90 could be designated as the compensating second moveable element, and element 88 as the first moveable element controlling basic rate of flow. Furthermore, element 88 could be held stationary and element 86 caused to rotate.

A further embodiment is shown in FIG. 9A–9D, that of a circular motion valve 170. The valve 170 comprises an assembly on a common shaft (not shown). The assembly comprises four plates 172, 174, 176, 178. One of the plates is an inlet plate 172, a second plate is the port area plate 174, a third is the holding plate 176, and finally the outlet plate 178. The four plates 172, 174, 176, 178 have a suitable fluid sealing means to be described below.

The inlet plate 172 of FIG. 9A comprises a fluid inlet fitting 140, a fluid inlet cavity 144, a hole 146 for receiving common assembly shaft, and a hole 142 for receiving the second moveable element positioning means.

The port area plate 174 in FIG. 9B comprises a port area 148 and shaft holes 142' and 146'.

The holding plate 176 in FIG. 9C contains a second moveable element 150. A motion generator means 152 can selectively position the second moveable element 150. The plate 174 also has holes 142" and 146".

The outlet plate 178 is shown in FIG. 9D and comprises a fluid outlet fitting 156, a fluid outlet cavity 158, and a leading edge 160 of said outlet cavity 158. The outlet plate 178 also comprises means to be rotated relative to the second moveable holding plate subassembly, and thereby comprising the first moveable element 172 with leading edge 160. Leading edge 160 is effective to expose more or less of port 148 whose effective area is compensated by the position of the second moveable element 150.

Figure 10:
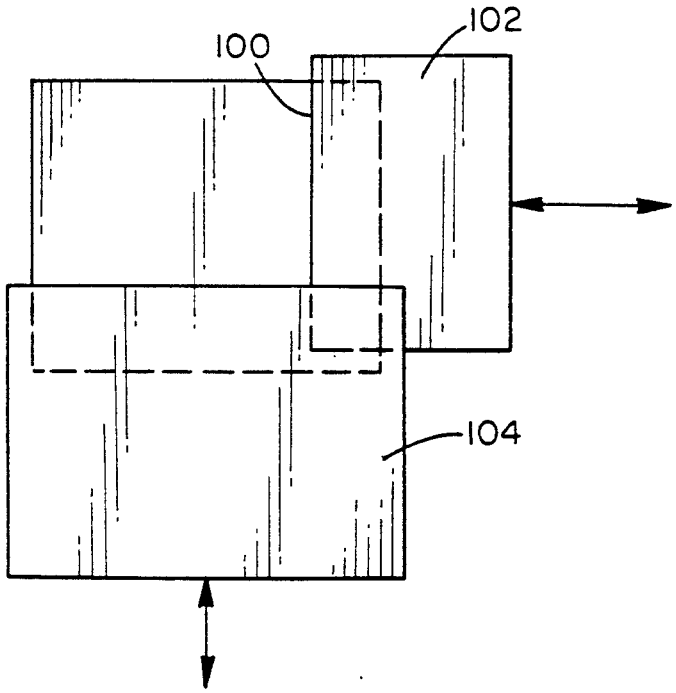
FIG. 10 is an alternate embodiment of the first and second moveable elements according to the invention.

With reference to FIG. 10, a still further modification of the invention is shown. The basic port area is shown as being rectangular in shape, with the leading edge 100 of a second moveable element 102 moving at right angles to the movement of a first moveable element 104.

Figure 11:
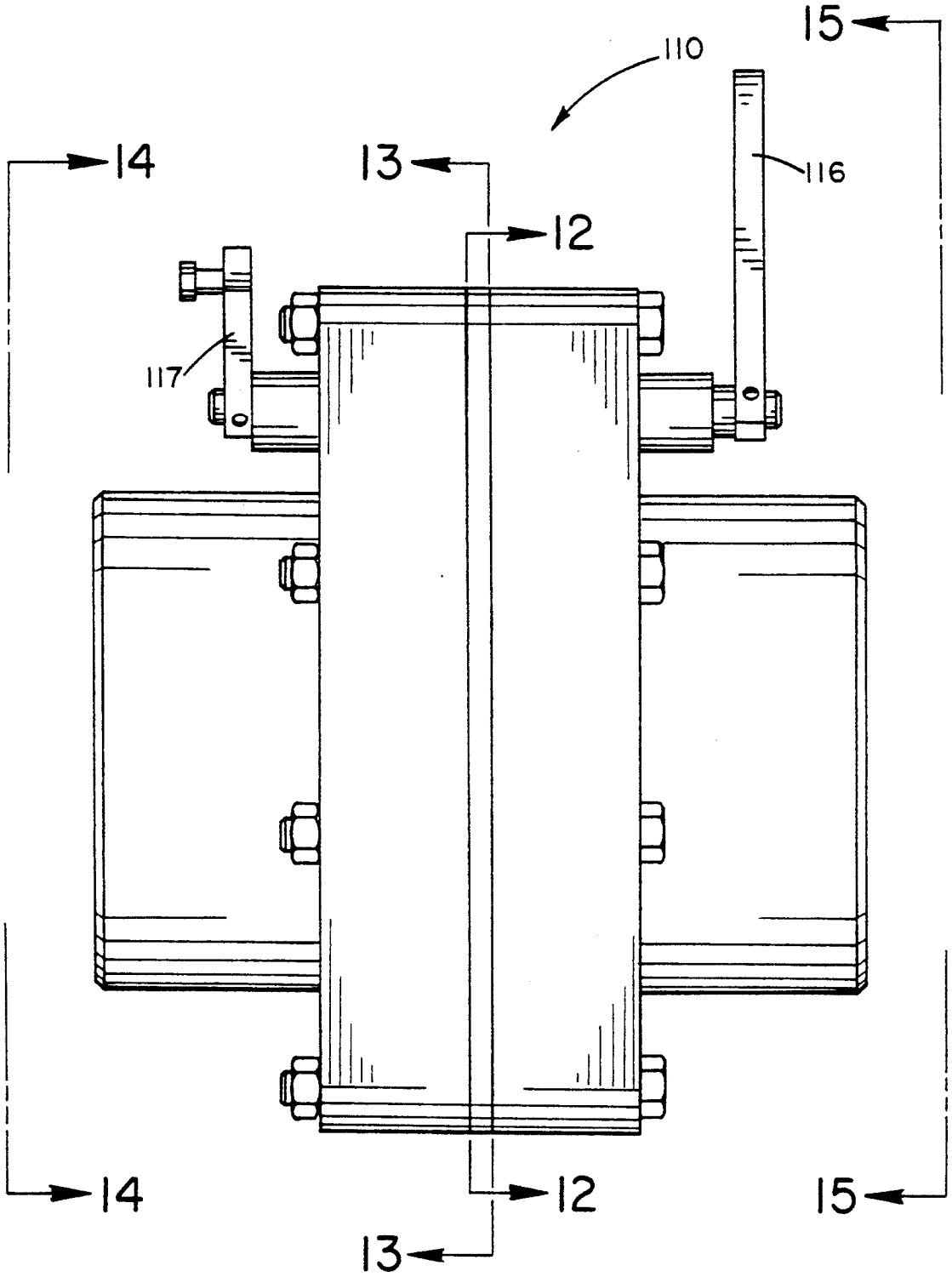
FIG. 11 is a side view of a fluid flow control valve according to the invention.
Figure 13:
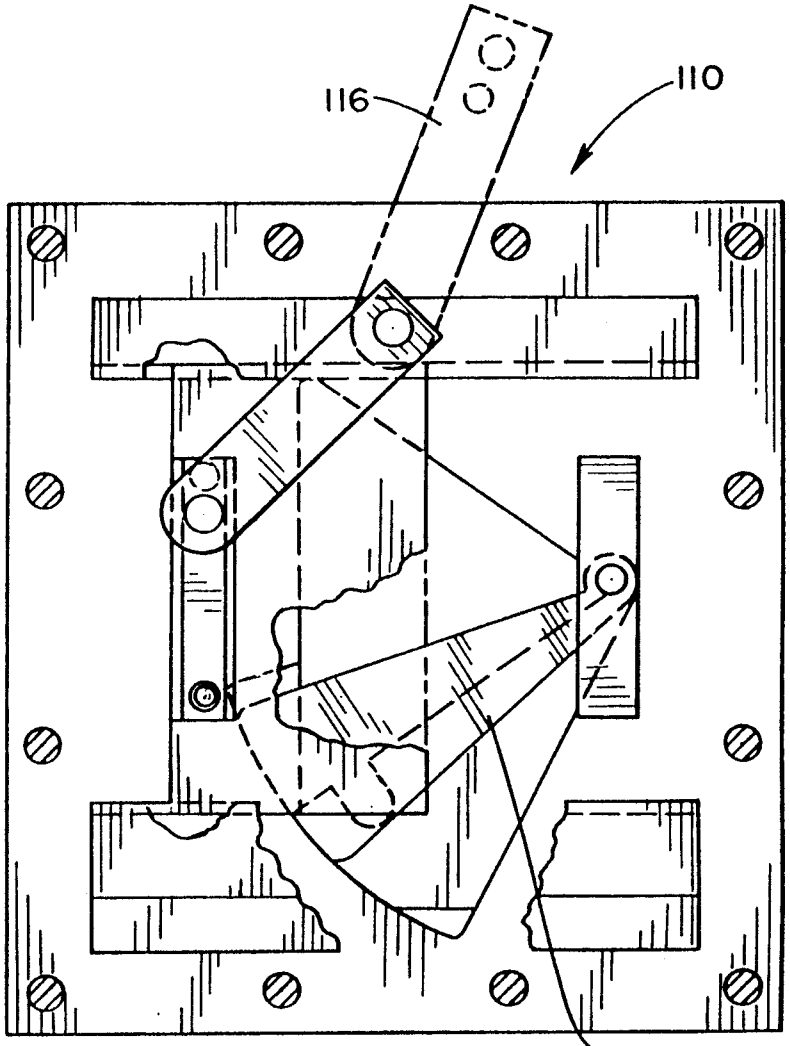
FIG. 13 is a cross-sectional view of the fluid flow control valve of FIG. 11 taken along line 13—13.
Figure 12:
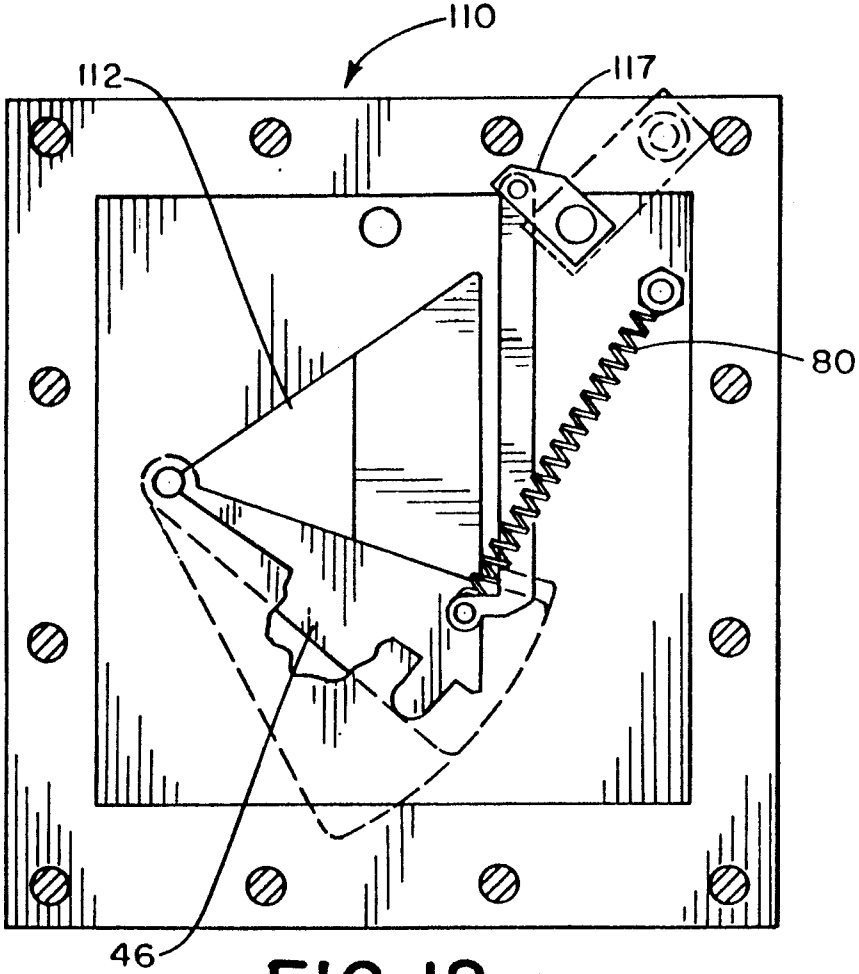
FIG. 12 is a cross-sectional view of the fluid flow control valve of FIG. 11 taken along line 12—12.
Figure 15:
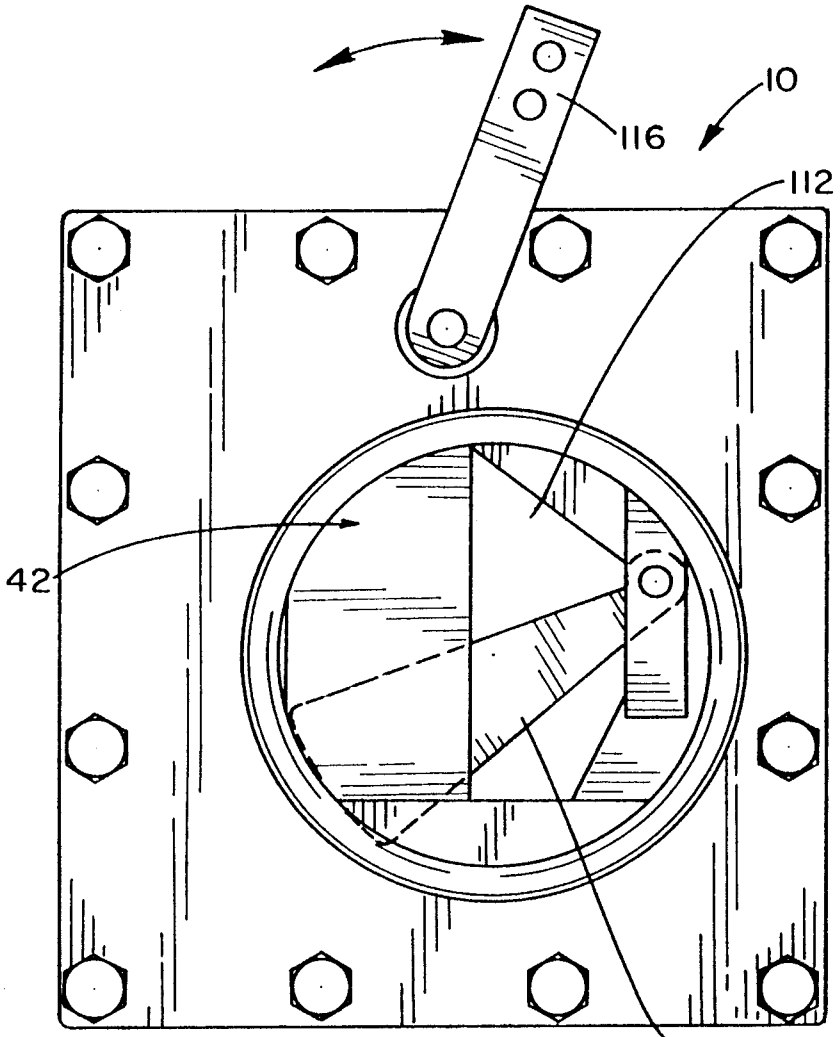
FIG. 15 is an end view of the fluid flow control valve of FIG. 11 taken along line 15—15.
Figure 14:
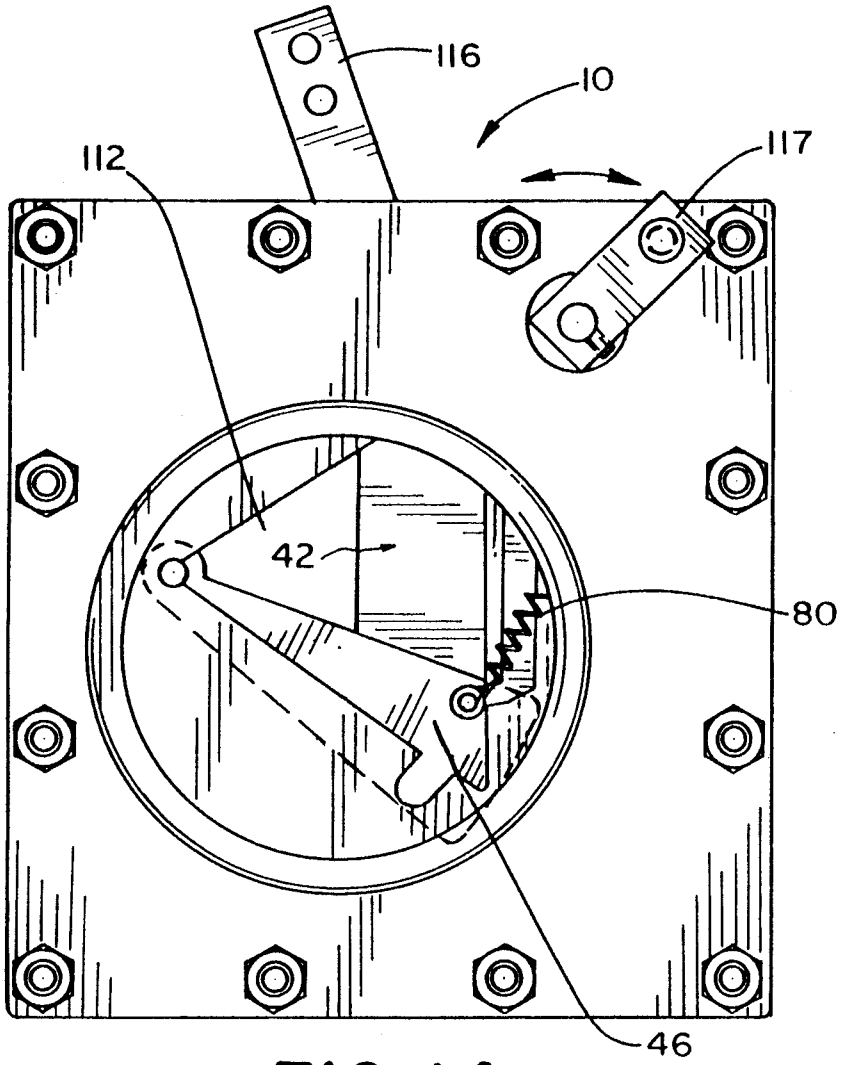
FIG. 14 is an end view of the fluid flow control valve of FIG. 11.

Applications of the schematic arrangement of FIG. 5 are shown FIGS. 11–15 and 16–20. In FIG. 11 control valve 110 is shown. The port 112 (FIG. 14) is triangular and its available area is limited by the position of the first moveable element 42 and the second moveable element 46. The movement of the first moveable element 42 is controlled by linkage 116. The movement of the second movable element 46 is controlled by linkage 117 (FIG. 12) or some suitable means of transmission which is typically attached to an actuator. The actuator receives signals from the controller 76. (see FIG. 7)

Figure 16:
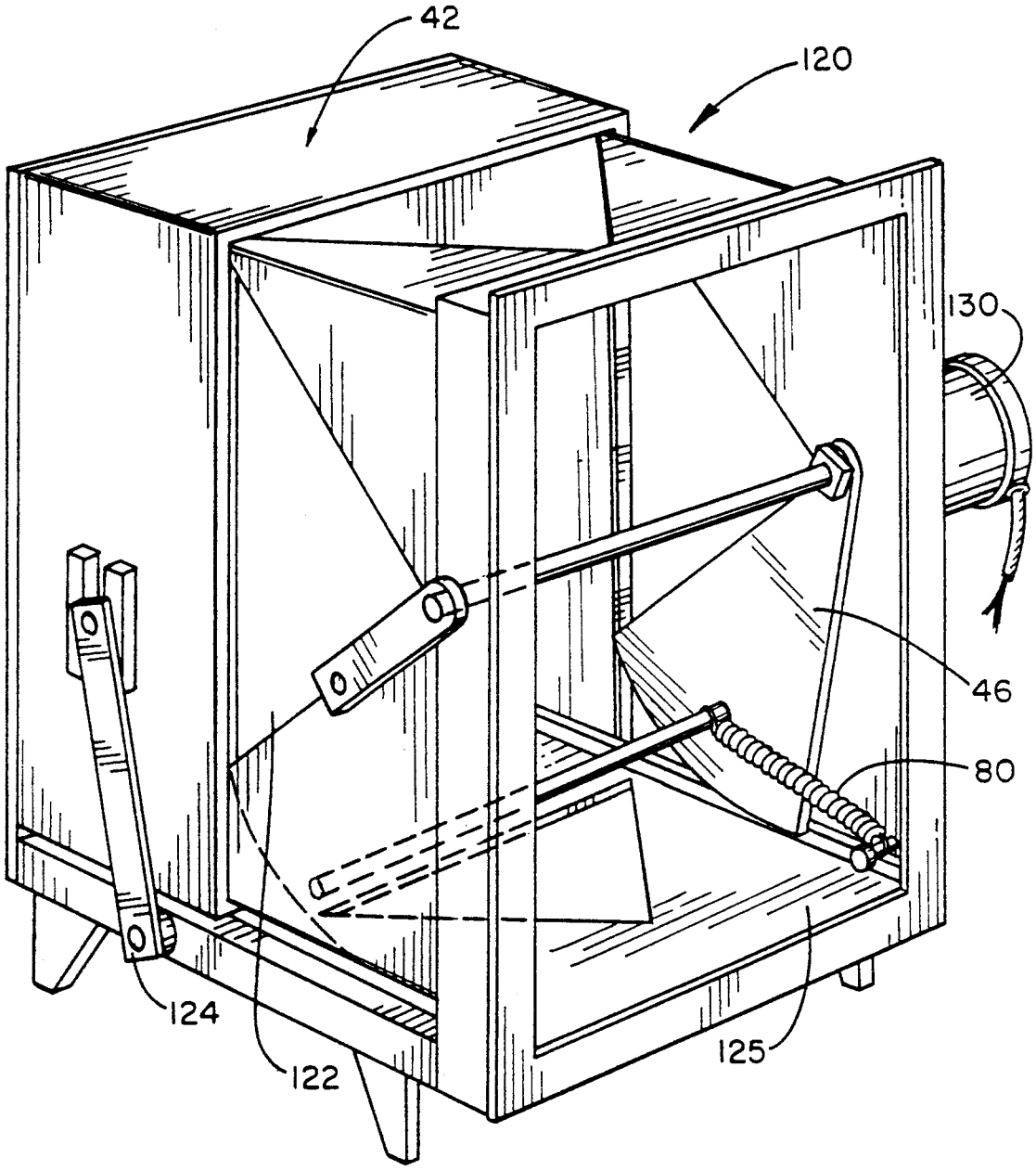
FIG. 16 is a perspective view of a fluid flow control valve according to the invention.
Figure 18:
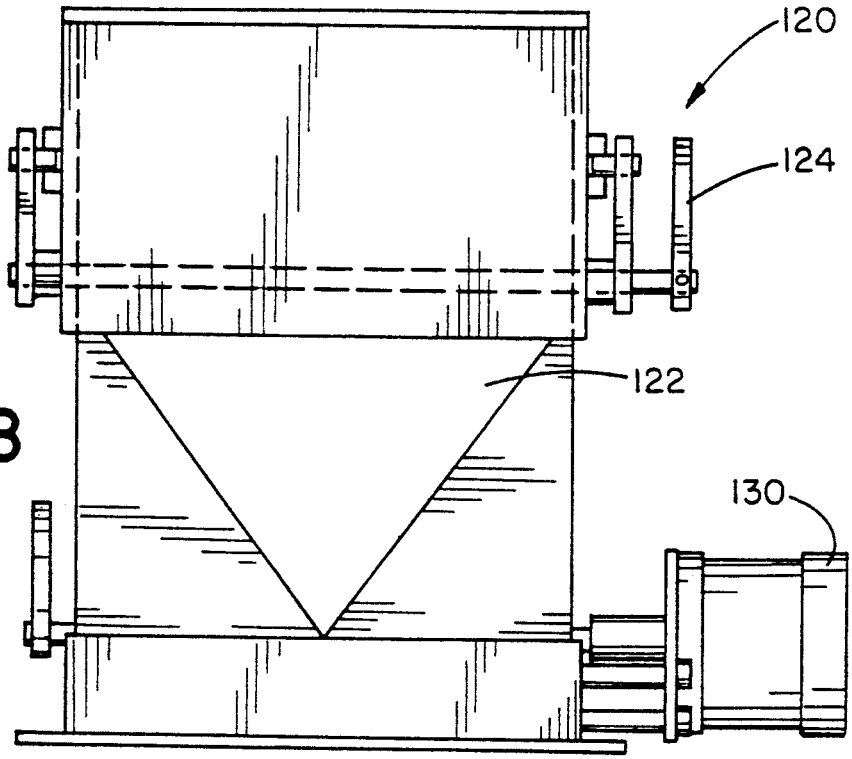
FIG. 18 is a top plan view of the fluid flow control valve of FIG. 16.
Figure 17:
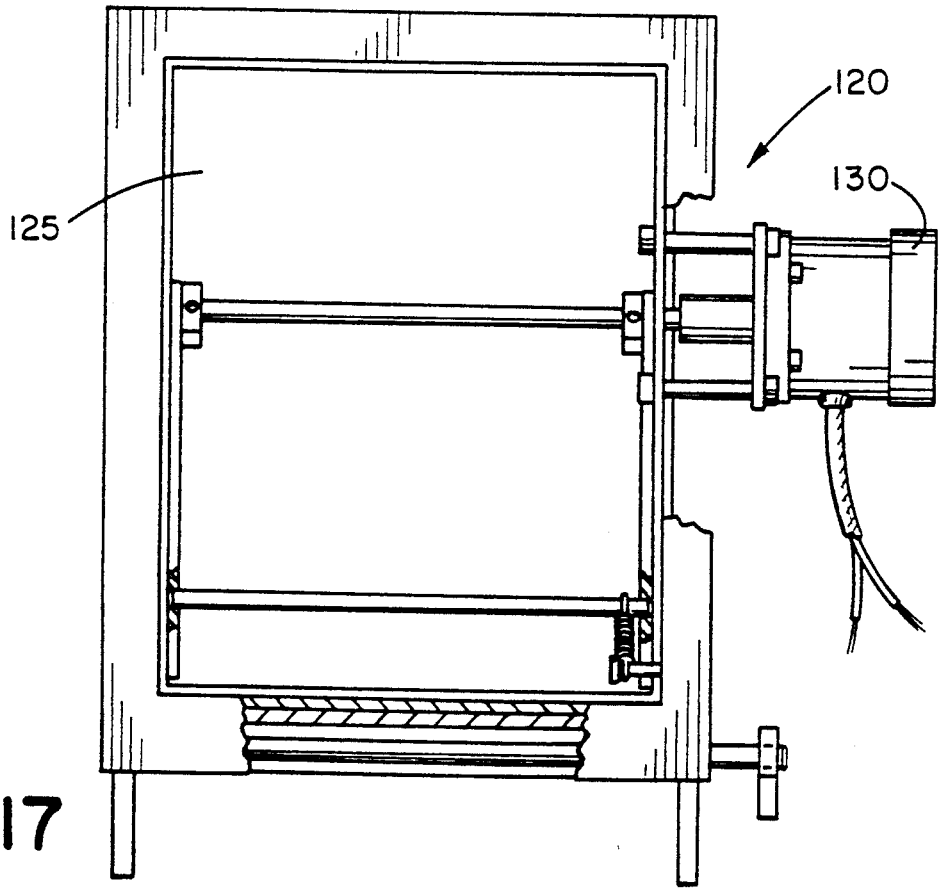
FIG. 17 is a front plan view of the fluid flow control valve of FIG. 16.
Figure 20:
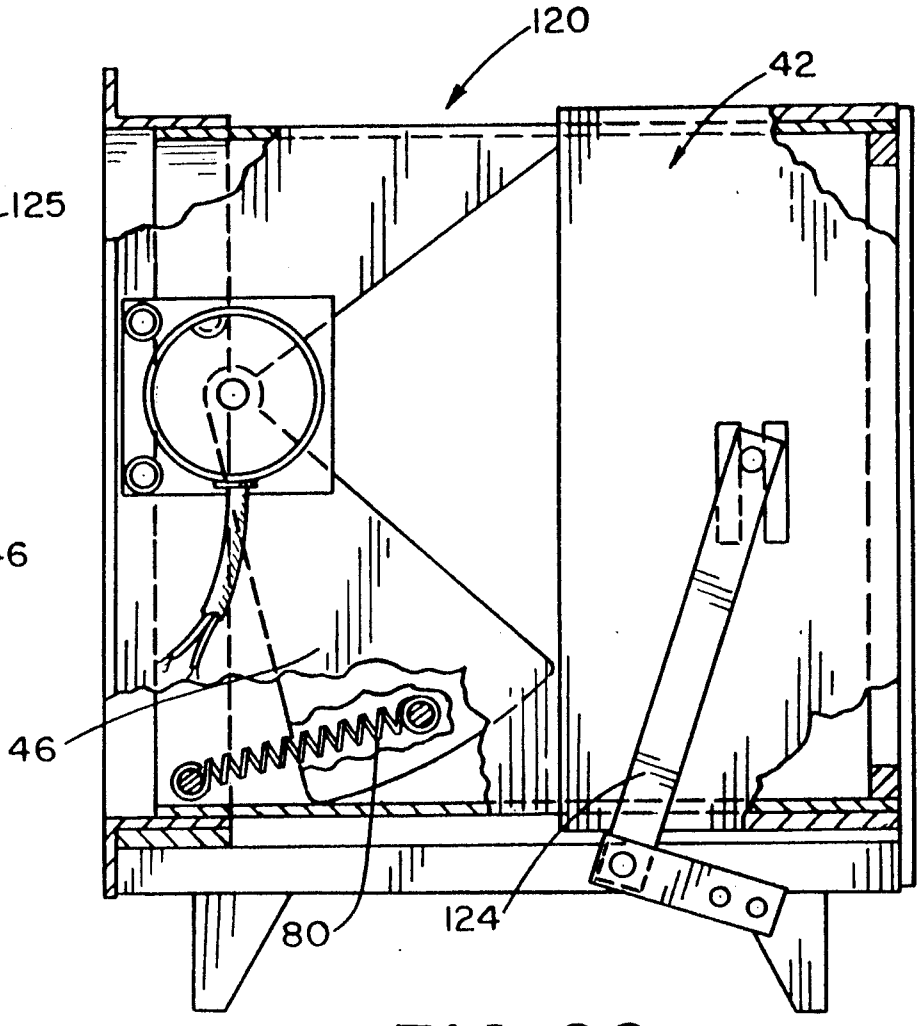
FIG. 20 is a right side view of the fluid flow supply control valve of FIG. 16.
Figure 19:
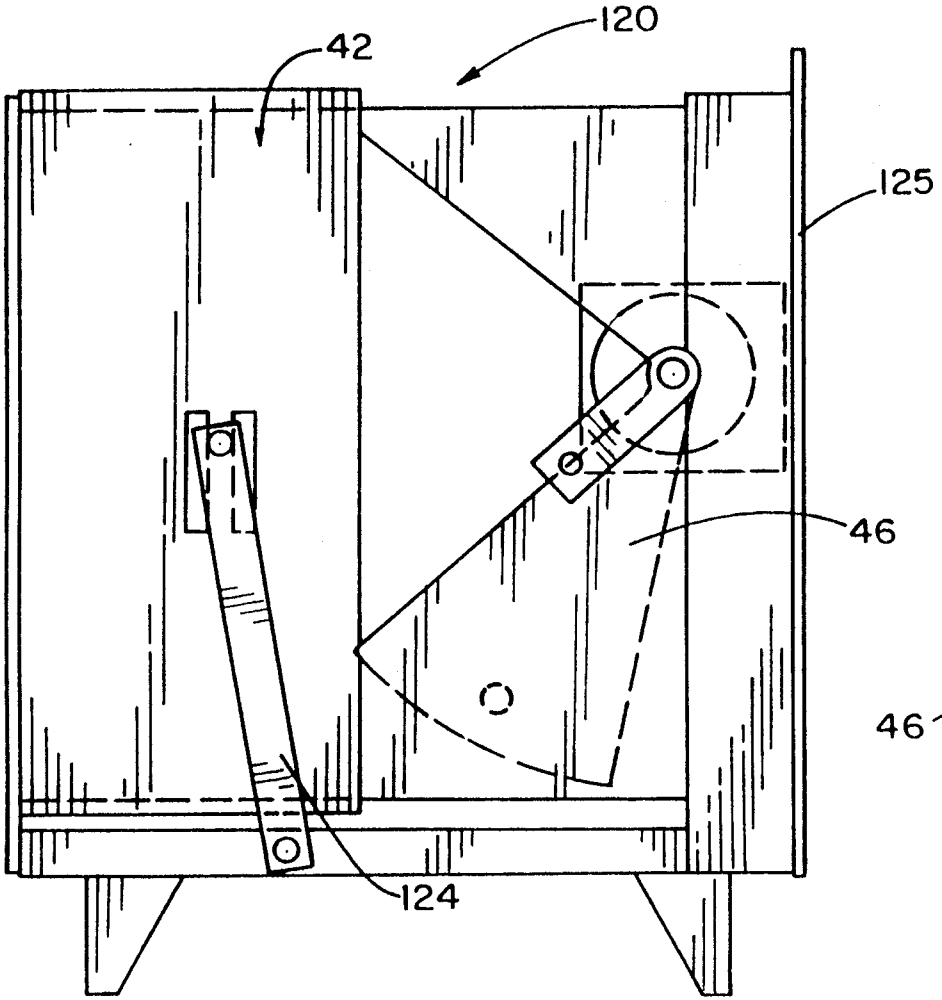
FIG. 19 is a left side view of the fluid flow supply control valve of FIG. 16.

With reference to FIGS. 16–20 a valve 120 is disclosed. The port area 122 (FIG. 16) is triangular in shape. A first moveable element 42 moves along an axis of the control valve 120 via linkage 124. A second moveable element 46 comprises a triangular shaped plate whose position is adjusted by actuator 130. Actuator 130, as shown in FIG. 16, is a stepping motor, alternate means may be employed to activate element 46. The fail safe spring designated 80 in FIG. 16 and FIG. 12 could be designed for tension or compression action as required.

Figure 21:
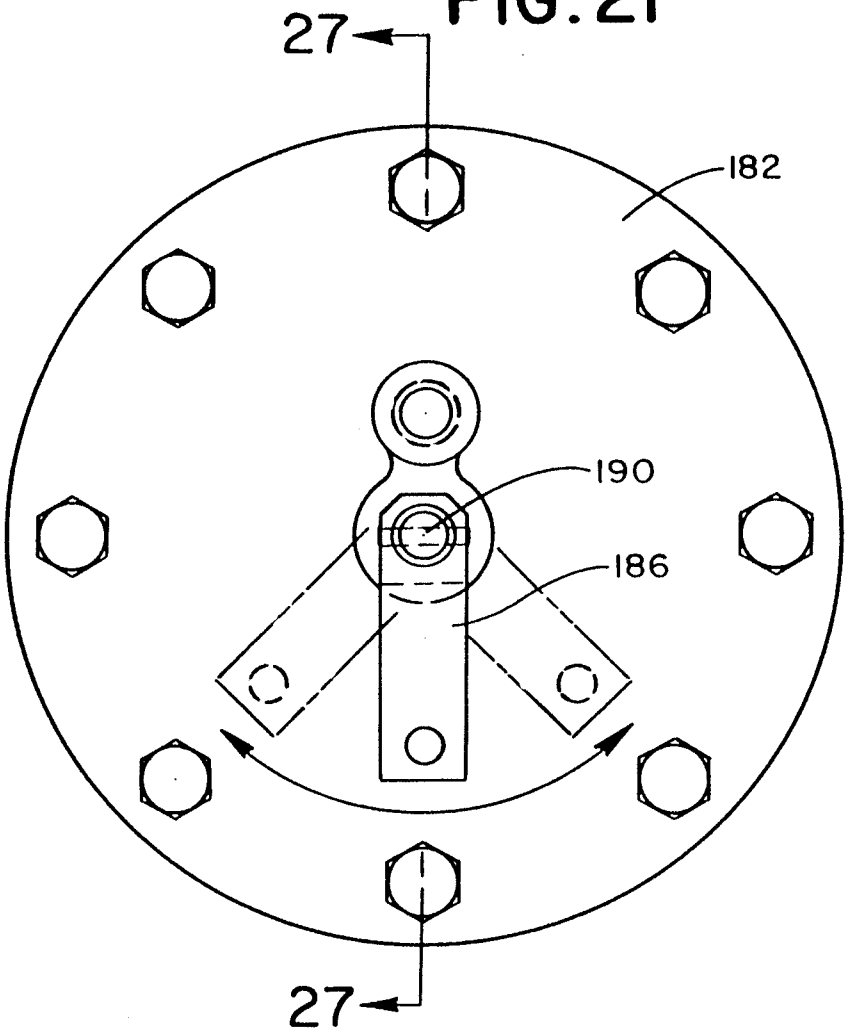
FIG. 21 is a front view of the outside front housing of the valve of FIG. 27.
Figure 24:
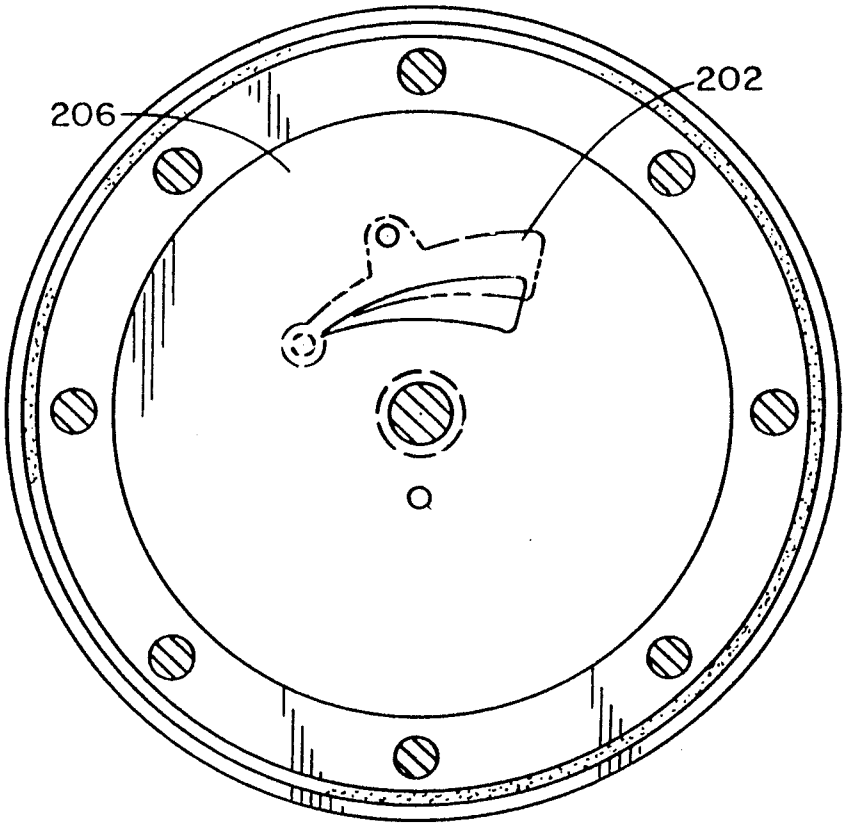
FIG. 24 is a front cross-sectional view of the circular valve of FIG. 27 taken along line 24—24.
Figure 23:
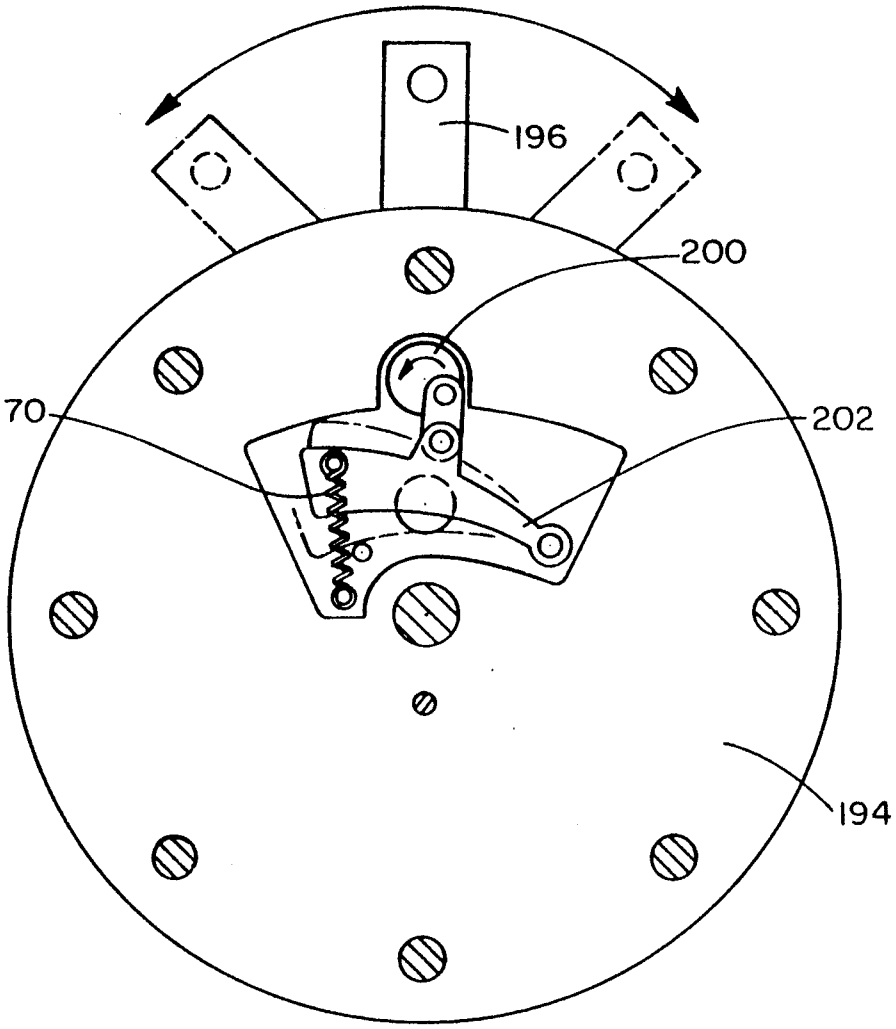
FIG. 23 is a cross-sectional view of the circular valve of FIG. 27 taken along line 23—23.
Figure 26:
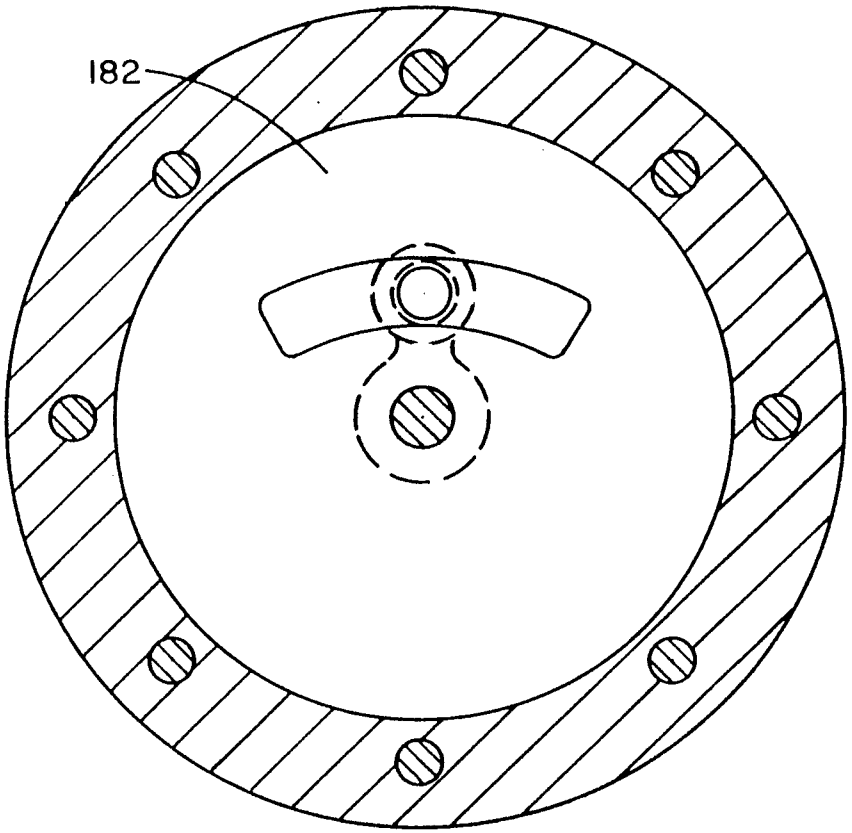
FIG. 26 is a front cross-sectional view of the circular valve of FIG. 21 taken along line 25—25; and, FIG. 27 is a side cross-sectional view of a circular valve according to one embodiment of the invention.
Figure 25:
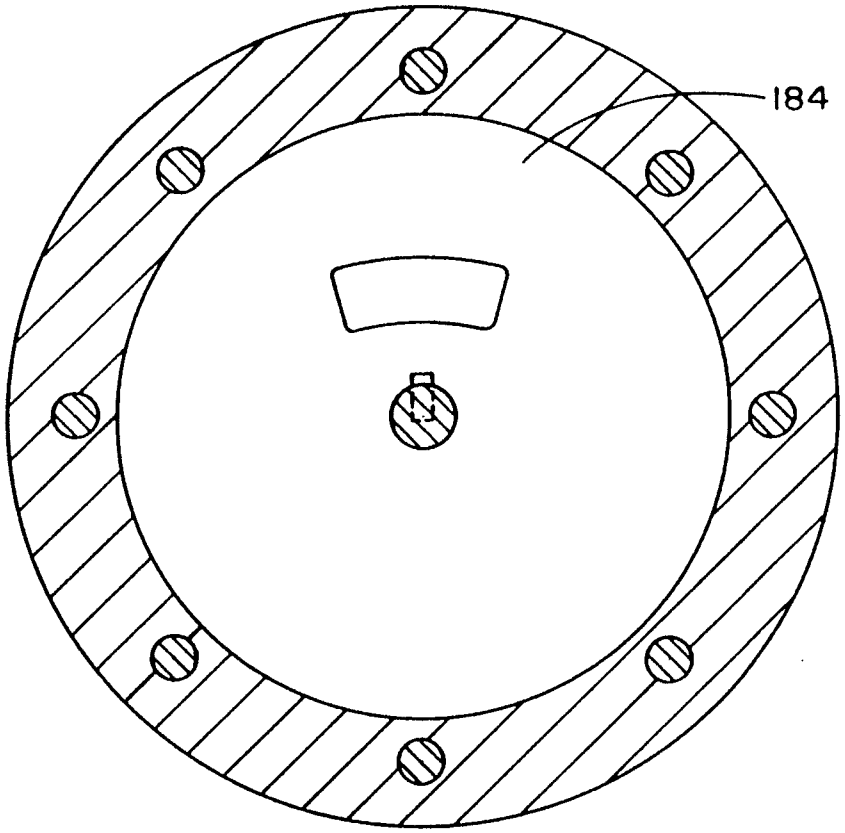
FIG. 25 is a front cross-sectional view of the circular valve of FIG. 27 taken along line 25—25.

With reference to FIGS. 21–27, an alternate embodiment of a circular valve 180 is disclosed. With reference to FIG. 21, a front housing 182 is disclosed. The front housing has a handle 186 rotatably attached to a shaft 190 which runs through the center of the valve 180.

Figure 22:
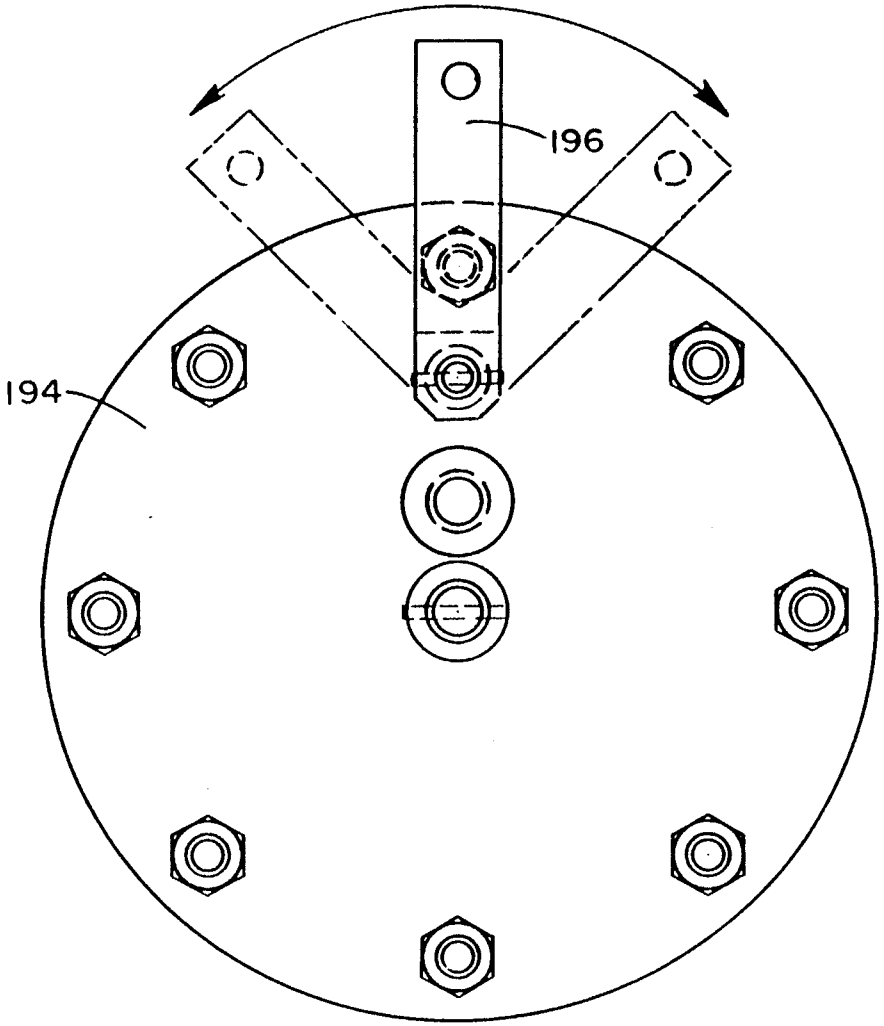
FIG. 22 is a back view of the outside back surface of the housing of the valve of FIG. 27.

With reference to FIG. 22, a back housing 194 is shown. Note that the back housing also features a handle 196.

With reference to FIG. 1–27, and especially FIGS. 23–27, the workings of this embodiment of a circular valve is described. With special reference to FIG. 23, note that movement of handle 196 causes rotation of eccentric 200, thereby causing movement of second moveable element 202. Likewise, movement of handle 186 causes movement of the first moveable element.

Figure 27:
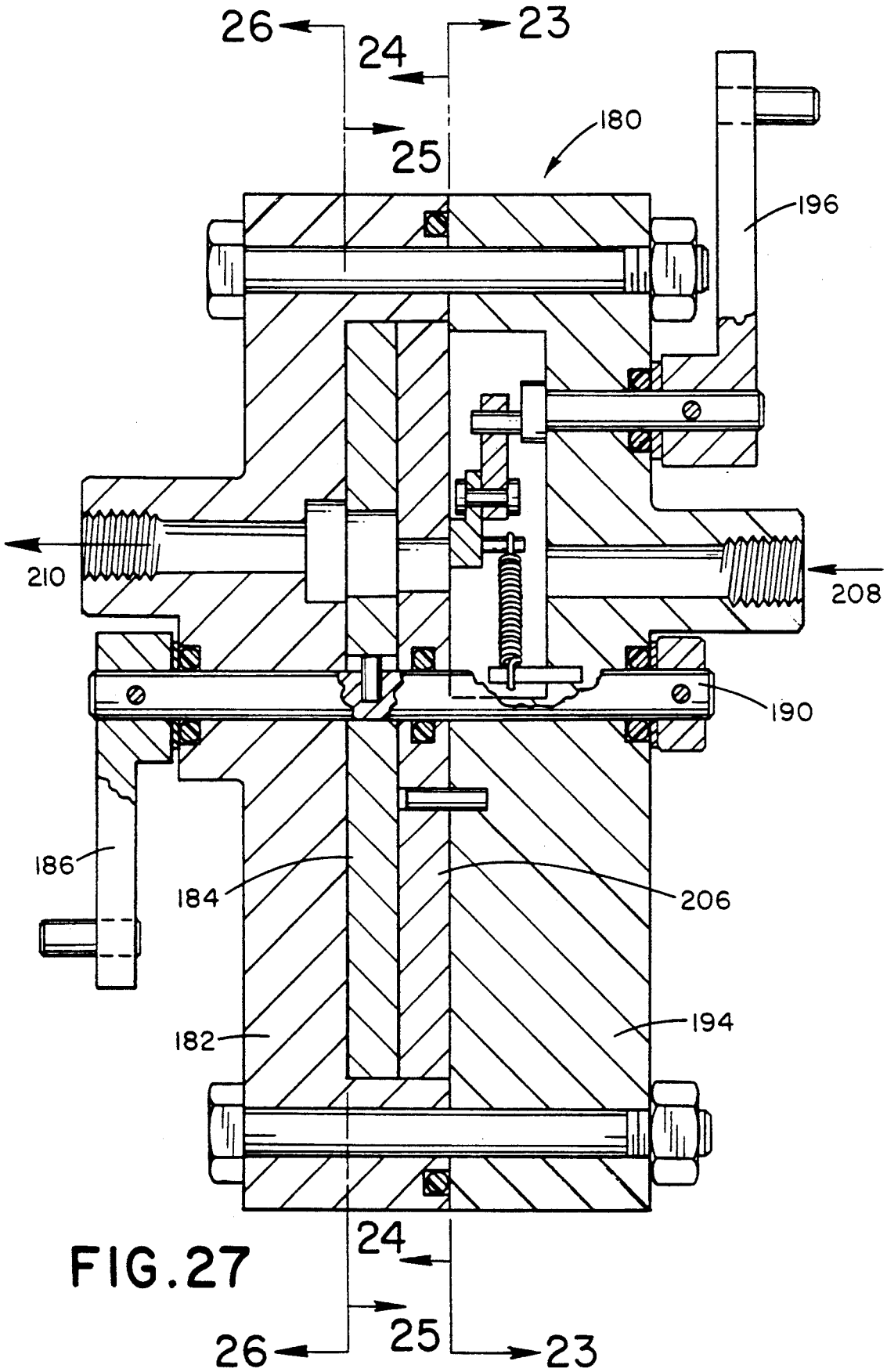

With reference to FIG. 27, the valve 180 has an inlet 208 and an outlet 210. The valve is comprises of a front housing 182, a first plate 184, a second plate 206, and a back housing 194. The first plate 184 contains the first moveable element while the second plate 206 contains the second moveable element. As described previously, rotation of handle 186 causes movement of the first moveable element while rotation of handle 196 causes movement of the second moveable element.

The invention has been described with reference to the preferred embodiment. Obviously, modifications and alternations will occur to others upon a reading and understanding of this specification. It is intended to include all such modifications and alterations insofar as they come within the scope of the appended claims or the equivalence thereof.

Having thus described the invention, it is now claimed:

1. In a control system for maintaining the desired air-to-fuel ratio during a combustion process occurring in a combustion apparatus and in which the control system includes a fuel flow control device having a fuel control means to control fuel flow, an air flow control device having an air control means to control air flow, means to interconnection the fuel control device and the air control device, said means comprising a fixed mechanical linkage, said linkage providing a fuel-to-air ratio throughout the range of energy release of the combustion apparatus, means to initially calibrate the relationship between the fuel flow control device and the air control device throughout the range of energy release of the combustion apparatus, there being a predetermined, fixed relationship between fuel flow and air flow throughout the entire range of operation of the combustion apparatus according to the initial calibration; the improvement comprising:

(a) a flow compensation means in at least one of said fuel flow control device and said air flow control device, said flow compensation means providing a means to change the rate of flow of at least one of said fuel flow control device and said air flow control device over the entire range of operation of the combustion apparatus, and thereby change the initial calibration between said fuel flow control device and said air flow control device in order to account for variations in air or fuel qualities caused by changes in pressure, changes in BTU content per unit volume of fuel, changes in oxygen content per unit volume of combustion air, or any combination thereof, said change to the initial calibration between said fuel flow control device and said air flow control device providing compensation to the current rate of energy release of the combustion apparatus, and simultaneously providing compensation to any and all rates of energy release within the operating range of the combustion apparatus.

2. The fuel flow control device of claim 1 wherein movement of said flow compensating means reduces or increases said fuel flow through said fuel flow control device less than 20%.

3. The fuel flow control device of claim 1 wherein said flow compensating means has a biased position.

4. The fuel flow control device of claim 3 wherein said biased position is created via a spring.

5. The fuel flow control device of claim 1 wherein said fuel flow control device is a V-port valve.

6. A method of adjusting a mix of fuel and air being supplied to a combustion apparatus, said combustion apparatus comprising a fuel flow rate control valve, an air flow rate control valve, an exhaust gas outlet, and a sensing apparatus, said fuel flow rate control valve comprising a port, and first and second moveable elements, movement of which adjusts the area of said port, said method comprising the steps of:

(1) calibrating said fuel flow rate control valve to an initial setting by moving said first moveable element to a first position, said calibration based on initial values of a series of combustion variables;

(2) sensing exhaust gases with said sensing apparatus;

(3) adjusting said port area of said fuel supply control valve by moving said second moveable element to a second position; and, (4) repeating steps 2 through 3 until said sensing apparatus senses a proper composition of exhaust gases.

7. An air flow control device for use with combustion chambers utilizing jack shaft combustion control, said air flow control device being mechanically linked to said jack shaft for control of combustion within said combustion chamber, said air flow control device comprising:

a port, said port having a port area, said air passing through said port;

a first moveable element for controlling a air flow rate through said port, movement of said first moveable element modifying said port area;

a second moveable element for adjusting said air flow rate through said port, movement of said second a movement generation means for moving said second moveable element between a first and second position in response to a signal from an associated exhaust gas analyzer.

8. The air flow control device of claim 7 wherein said flow compensating means has the same geometric form as said port in said air flow control device.

9. The air flow control device of claim 7 wherein movement of said flow compensating means reduces or increases said air flow less than 20%.

10. The air flow control device of claim 7 wherein said flow compensating means has a biased position.

11. The air flow control device of claim 10 wherein said biased position is created via a spring.

12. The air flow control device of claim 7 wherein said air flow control device is a V-port valve.

13. The air flow rate control device of claim 7 wherein said second moveable element is selectively moveable in a direction not parallel to movement of said first moveable element.

14. A method of adjusting a mix of fuel and air being supplied to a combustion chamber, said combustion chamber comprising a fuel flow rate control valve, an air flow rate control valve, an exhaust gas outlet, and a sensing apparatus, said air flow rate control valve comprising a port, and first and second moveable elements, movement of which adjusts the area of said port, said method comprising the steps of:

(1) calibrating said air flow rate control valve to an initial setting by moving said first moveable element to a first position, said calibration based on initial values of a series of combustion variables;

(2) sensing exhaust gases with said sensing apparatus;

(3) adjusting said port area of said air flow rate control valve by moving said second moveable element to a second position; and, (4) repeating steps 2 through 3 until said sensing apparatus senses a proper composition of exhaust gases.

15. A fuel flow rate control device for use with a combustion apparatus, said fuel flow rate control device being mechanically linked to a jack shaft for control of combustion within a combustion chamber, said fuel flow rate control device comprising:

a port, said port having a port area, fuel passing through said port;

a first moveable element for controlling a fuel flow rate through said port, movement of said first moveable element modifying said port area to establish a specific relationship between the position of said first moveable element and resultant fuel flow;

a second moveable element for adjusting said specific relationship between the position of said first moveable element and resultant fuel flow, movement of said second moveable element modifying said port area available to said first moveable element; and, a movement generation means for moving said second moveable element between a first and second position in response to a signal from an associated exhaust gas analyzer and controller.

16. The fuel flow rate control device of claim 15 wherein said second moveable element is selectively moveable in a direction not parallel to movement of said first moveable element.

17. In a control system for maintaining the desired air-to-fuel ratio during a combustion process occurring in a combustion apparatus and in which the control system includes a fuel flow, an air flow control device having an air control means to control air flow, means to interconnect the fuel control device and the air control device, said means comprising a single point, specific, unaltered signal, said signal providing a fuel-to-air ratio throughout the range of energy release of the combustion apparatus, means to initially calibrate the relationship between the fuel flow control device and the air control device throughout the range of energy release of the combustion apparatus, there being a predetermined, fixed relationship between fuel flow and air flow throughout the entire range of operation of the combustion apparatus according to the initial calibration; the improvement comprising:

(a) a flow compensation means in at least one of said fuel flow control device and said air flow control device, said flow compensating means providing a means to change the range of flow of at least one of said fuel flow control device and said air flow control device over the entire range of operation of the combustion apparatus, and thereby change the initial calibration between said fuel flow control device and said air flow control device in order to account for variations in air or fuel qualities caused by changes in pressure, changes in BTU content per unit volume of fuel, changes in oxygen content per unit volume of combustion air, or any combination thereof, said change to the initial calibration between said fuel flow control device and said air flow control device providing compensation to the current rate of energy release of the combustion apparatus, and simultaneously providing compensation to any and all rates of energy release within the operating range of the combustion apparatus.

* * * * *